US012534899B2

(12) United States Patent
Swanson et al.

(10) Patent No.: US 12,534,899 B2
(45) Date of Patent: Jan. 27, 2026

(54) TRENCH DRAINS WITH SUSPENDED GRATES

(71) Applicant: Midwest Design Group, Indianapolis, IN (US)

(72) Inventors: Daniel Swanson, Fishers, IN (US); Daniel Cohoat, McCordsville, IN (US); Stephen Little, Fishers, IN (US); Hitendra Patel, Westfield, IN (US); Thomas Cohoat, Westfield, IN (US)

(73) Assignee: Midwest Design Group, Indianapolis, IN (US)

( * ) Notice: Subject to any disclaimer, the term of this patent is extended or adjusted under 35 U.S.C. 154(b) by 516 days.

(21) Appl. No.: 18/078,485

(22) Filed: Dec. 9, 2022

(65) Prior Publication Data

US 2024/0191492 A1 Jun. 13, 2024

(51) Int. Cl.
*E03F 5/06* (2006.01)

(52) U.S. Cl.
CPC ..... *E03F 5/06* (2013.01)

(58) Field of Classification Search
None
See application file for complete search history.

(56) References Cited

U.S. PATENT DOCUMENTS 59,804 A * 11/1866 Whitehead ..... E03F 5/046 404/4
63,284 A * 3/1867 Miller ..... E03F 5/0404 210/163
319,112 A * 6/1885 Nevius ..... E01C 11/223 138/108
355,330 A * 1/1887 Locke ..... E01C 11/223 138/108
RE10,980 E * 1/1889 Locke ..... 404/3
469,044 A * 2/1892 Jungbluth ..... A01K 1/0103 404/2
494,620 A * 4/1893 Bedgood ..... E01C 11/227 404/2
630,533 A * 8/1899 Fiske ..... A01K 1/0151 119/528

(Continued)

FOREIGN PATENT DOCUMENTS

CN 210621888 U * 5/2020
DE 3824755 A1 * 1/1990 ..... E03F 3/046

(Continued)

*Primary Examiner* — Robert J Popovics
(74) *Attorney, Agent, or Firm* — Arlene Neal; Neal Blibo LLC

(57) ABSTRACT

A strap-supported grate section in a surface-supported drain grate system includes a drain grate; at least one inner strapping member having a middle portion affixed on a top facing inner section of the drain grate; and two anchor strapping members, each of which has a middle portion that is affixed on a top facing edge of the drain grate. Outer portions of each anchor strapping member and outer portions of the inner strapping member are not affixed to the drain grate. The outer portions of the anchor strapping members and the inner strapping member are surface mountable on a surface adjacent to a drain structure in which the strap-supported grate section is inset to provide structural support for the strap-supported grate section.

19 Claims, 14 Drawing Sheets

(56) References Cited

U.S. PATENT DOCUMENTS 669,495 A * 3/1901 Babcock ..... E04D 13/076 248/48.1
775,791 A * 11/1904 Austin ..... E01C 11/223 404/2
814,308 A * 3/1906 Marriott ..... E03F 5/046 404/4
888,753 A * 5/1908 Schodde ..... E03F 3/046 405/118
973,442 A * 10/1910 Lees ..... E03F 3/046 405/118
1,406,068 A * 2/1922 George ..... E01C 9/02 238/178
1,444,198 A * 2/1923 Mcqueary ..... 404/2
2,026,498 A * 12/1935 Hohorst ..... E03F 5/04 210/164
2,182,795 A * 12/1939 Day ..... E03F 5/0404 210/434
2,386,020 A * 10/1945 Wendelken ..... E01C 11/227 D25/164
2,436,593 A * 2/1948 Moselowitz ..... E01C 11/221 D25/164
2,649,720 A * 8/1953 Heltzel ..... E01C 11/227 404/2
2,701,027 A * 2/1955 Scoville ..... E03F 5/0401 220/DIG. 25
2,938,437 A * 5/1960 Daley ..... E03F 5/046 285/125.1
3,039,575 A * 6/1962 Graham ..... E04C 2/427 D25/155
3,212,267 A * 10/1965 Biehn ..... E01F 5/005 405/118
3,221,616 A * 12/1965 Flegel ..... E03F 5/046 49/464
3,225,545 A * 12/1965 Flegel ..... E01C 11/227 404/2
3,465,654 A * 9/1969 Harry ..... E01C 11/106 52/126.2
3,666,104 A * 5/1972 Aprill, Jr. ..... E01C 11/227 210/477
3,714,786 A * 2/1973 Evans ..... E02B 11/005 405/49
3,788,756 A * 1/1974 Ito ..... E01D 19/086 404/4
3,815,213 A * 6/1974 Evans ..... E01C 11/227 29/446
3,876,322 A * 4/1975 Deason ..... E04H 4/141 210/163
3,882,743 A * 5/1975 Evans ..... E02B 11/005 83/156
3,898,778 A * 8/1975 Erickson ..... E04G 11/04 264/32
3,945,746 A * 3/1976 Bredbenner ..... E03F 5/06 210/163
4,007,566 A * 2/1977 Molitor ..... E04H 4/1227 52/169.7
4,136,010 A * 1/1979 Pilie ..... E03F 5/0401 210/164
4,142,329 A * 3/1979 Williams ..... E05B 65/006 49/465
D259,950 S * 7/1981 Henry ..... D23/259
4,365,911 A * 12/1982 Rossberg ..... E01C 11/227 404/2
4,367,142 A * 1/1983 Blecher ..... E03F 5/06 52/302.1
4,382,414 A * 5/1983 Svirklys ..... B65D 19/0097 24/294
4,387,882 A * 6/1983 Mansour ..... A01K 3/002 256/17
4,407,055 A * 10/1983 Rossberg ..... E01C 11/224 29/890.14
4,451,172 A * 5/1984 Lamphier ..... E01C 11/227 405/126
4,472,078 A * 9/1984 Karbstein ..... E01C 11/227 404/2
4,490,067 A * 12/1984 Dahowski ..... E01C 11/227 52/169.5
4,498,807 A * 2/1985 Kirkpatrick ..... E03F 3/046 210/163
4,515,498 A * 5/1985 Thomann ..... E01C 11/227 D25/155
4,553,874 A * 11/1985 Thomann ..... E01C 11/227 52/662
4,560,302 A * 12/1985 Karbstein ..... E01C 11/227 404/2
4,561,801 A * 12/1985 Nantz ..... E02B 5/00 405/15
RE32,248 E * 9/1986 Blecher ..... E03F 5/06 52/302.1
4,621,939 A * 11/1986 Thomann ..... E01C 11/227 404/4
4,630,962 A * 12/1986 Thomann ..... E01C 11/227 210/163
4,630,966 A * 12/1986 Karbstein ..... E01C 11/227 138/155
4,640,643 A * 2/1987 Williams ..... E01C 11/227 405/118
4,699,544 A * 10/1987 Karbstein ..... E01C 11/227 138/155
4,751,945 A * 6/1988 Williams ..... F16L 1/028 174/101
4,787,773 A * 11/1988 Kehler ..... E01C 11/227 405/36
4,815,888 A * 3/1989 Stegmeier ..... E04F 15/14 404/4
4,838,727 A * 6/1989 Capuano ..... E01C 11/227 404/2
4,844,655 A * 7/1989 Aleshire ..... E03F 3/046 52/741.11
4,878,782 A * 11/1989 Beattie ..... E02B 13/00 405/119
4,883,394 A * 11/1989 Van der Woude .... E02D 29/124 411/908
4,940,359 A * 7/1990 Van Duyn ..... E01C 11/227 405/126
4,952,094 A * 8/1990 Spiess ..... E02D 29/1427 405/36
4,955,752 A * 9/1990 Ferns ..... E03F 5/06 52/507
RE33,439 E * 11/1990 Thomann ..... E01C 11/227 210/163
4,968,170 A * 11/1990 Wilson ..... E04C 2/423 52/669
4,986,693 A * 1/1991 Salberg ..... E01C 11/223 404/98
4,993,877 A * 2/1991 Beamer ..... E01C 19/506 405/282
4,993,878 A * 2/1991 Beamer ..... E01C 19/506 405/282
5,000,621 A * 3/1991 Beamer ..... E03F 3/046 405/282
5,024,550 A * 6/1991 Mainville ..... E03F 5/06 210/163
5,026,202 A * 6/1991 Thomann ..... E01C 11/227 404/5
5,039,263 A * 8/1991 Meyer ..... E02D 29/124 411/908
5,066,165 A * 11/1991 Wofford ..... E03F 3/046 405/118
5,106,231 A * 4/1992 Thomann ..... E01C 11/227 405/36
5,110,235 A * 5/1992 Thomann ..... E03F 5/06 49/465
5,130,016 A * 7/1992 Gavin ..... E03F 5/06 210/164
5,133,619 A * 7/1992 Murfae ..... B01D 24/12 404/5
5,135,331 A * 8/1992 Steiner ..... A63C 19/00 404/32

(56) References Cited

U.S. PATENT DOCUMENTS 5,179,752 A * 1/1993 Clough ..... E03F 5/06 14/74
5,181,793 A * 1/1993 Dekel ..... E01C 11/227 404/47
5,213,438 A * 5/1993 Barenwald ..... E03F 3/046 405/118
5,226,748 A * 7/1993 Barenwald ..... E02B 5/00 405/121
D339,415 S * 9/1993 Kiras ..... D23/397
5,256,000 A * 10/1993 Beamer ..... E03F 3/046 404/2
5,281,051 A * 1/1994 Stegall ..... E03F 3/046 405/118
5,281,052 A * 1/1994 Beamer ..... E03F 3/046 249/11
5,326,189 A * 7/1994 Beamer ..... E02D 27/02 405/118
5,326,190 A * 7/1994 Beamer ..... E03F 3/046 405/118
5,340,234 A * 8/1994 Rossi ..... E01C 11/227 405/48
5,372,457 A * 12/1994 Rante ..... E02B 11/005 52/155
5,372,714 A * 12/1994 Logue, Jr. ..... E03F 5/0404 404/5
5,380,121 A * 1/1995 Schluter ..... E01C 11/227 210/164
D355,707 S * 2/1995 Emanuele ..... D25/48.8
5,393,171 A * 2/1995 Stegall ..... E03F 3/046 405/118
5,399,047 A * 3/1995 Stegall ..... E03F 3/046 405/118
5,409,602 A * 4/1995 Sorenson ..... E04D 13/0767 52/12
5,437,516 A * 8/1995 Sauerwein ..... F16B 21/075 411/509
5,443,327 A * 8/1995 Akkala ..... E03F 3/046 405/118
5,454,663 A * 10/1995 Stegmeier ..... E04H 4/1227 52/169.5
5,462,382 A * 10/1995 Sauerwein ..... E01C 11/227 49/463
5,462,383 A * 10/1995 Van 'T Veer ..... E01C 11/227 404/4
5,466,091 A * 11/1995 Sauerwein ..... E02D 29/1427 405/36
5,468,096 A * 11/1995 Sauerwein ..... E02D 29/1427 405/36
5,478,169 A * 12/1995 Stegall ..... E03F 3/046 249/11
5,489,163 A * 2/1996 Thomann ..... E03F 5/0408 405/126
5,522,675 A * 6/1996 Gunter ..... E03F 3/046 24/336
5,529,436 A * 6/1996 Meyers ..... E03F 3/046 405/118
5,538,361 A * 7/1996 Beamer ..... E03F 3/046 249/11
5,564,857 A * 10/1996 Schluter ..... E02B 11/005 405/36
5,564,860 A * 10/1996 Amann ..... E03F 5/06 411/549
5,568,995 A * 10/1996 Beamer ..... E03F 3/046 405/118
5,573,351 A * 11/1996 Beamer ..... E03F 3/046 404/4
5,575,925 A * 11/1996 Logue, Jr. ..... E03F 5/0404 404/5
5,613,804 A * 3/1997 Beamer ..... E03F 3/046 405/118
5,645,367 A * 7/1997 Gunter ..... E03F 3/046 404/2
5,647,689 A * 7/1997 Gunter ..... E03F 3/046 405/36
5,647,692 A * 7/1997 Gunter ..... E01C 11/227 473/278
5,653,553 A * 8/1997 Gunter ..... E02B 5/00 405/36
5,702,204 A * 12/1997 Gunter ..... E03F 3/046 405/118
5,718,537 A * 2/1998 Becker ..... E01C 11/227 405/121
5,729,937 A * 3/1998 Mantelli ..... E03F 3/046 52/169.7
5,734,999 A * 4/1998 Nicholas ..... E04H 4/1236 4/496
5,735,637 A * 4/1998 Gunter ..... E03F 3/046 405/36
5,735,638 A * 4/1998 Beamer ..... E03F 3/046 405/118
5,779,393 A * 7/1998 Gunter ..... E01C 13/08 405/121
5,803,662 A * 9/1998 Gunter ..... E01C 13/00 405/36
5,810,513 A * 9/1998 Beamer ..... E01C 11/227 405/118
5,839,852 A * 11/1998 Mattson ..... E01C 11/225 14/2.4
5,853,265 A * 12/1998 Gunter ..... E01C 11/227 404/4
5,864,990 A * 2/1999 Tu ..... E03F 5/06 52/12
5,879,106 A * 3/1999 Beamer ..... E03F 3/046 249/11
5,882,145 A * 3/1999 Beamer ..... E01C 11/227 249/11
5,890,839 A * 4/1999 Gunter ..... E04G 15/06 405/118
5,908,266 A * 6/1999 Miller ..... E01C 11/227 405/36
5,971,662 A * 10/1999 Becker ..... E03F 3/046 404/2
6,000,881 A * 12/1999 Becker ..... E03F 3/046 405/52
6,004,068 A * 12/1999 Hosley ..... E04G 9/08 405/118
6,027,283 A * 2/2000 Schweinberg ..... E03F 3/046 405/118
6,113,311 A * 9/2000 Becker ..... E01C 11/227 405/121
6,129,838 A * 10/2000 Millner ..... E04D 13/0459 52/302.1
6,132,137 A * 10/2000 Gunter ..... E01C 13/08 405/121
6,141,916 A * 11/2000 Shackelford ..... E03F 3/046 52/12
6,170,095 B1 * 1/2001 Zars ..... E04H 4/1236 4/507
6,170,796 B1 * 1/2001 Gunter ..... E03F 3/046 249/144
6,220,784 B1 * 4/2001 Bricker ..... E03F 3/046 249/11
6,230,468 B1 * 5/2001 Klaus ..... E02D 31/06 52/287.1
6,280,117 B1 * 8/2001 Obermeyer ..... E02B 11/00 405/36
6,294,095 B1 * 9/2001 Lewis ..... E03F 1/00 210/477
6,298,621 B1 * 10/2001 Lee ..... E02D 5/185 52/60
6,443,656 B1 * 9/2002 Gunter ..... E01C 19/506 403/324
6,453,482 B1 * 9/2002 Mullings ..... E04H 4/1236 4/286
6,533,497 B2 * 3/2003 Gunter ..... E01C 19/506 403/324
6,588,029 B2 * 7/2003 Mullings ..... E04H 4/1236 4/286

(56) References Cited

U.S. PATENT DOCUMENTS 6,595,720 B2 * 7/2003 Humphries ..... E03F 3/046 405/118
6,612,780 B2 * 9/2003 Dahowski ..... E03F 3/046 210/170.1
6,663,317 B1 * 12/2003 Williams ..... E03F 3/046 405/48
6,729,795 B2 * 5/2004 Dahowski ..... E04H 4/1227 404/4
6,746,179 B1 * 6/2004 Kerkhoff ..... A01K 1/0103 405/41
6,792,723 B2 * 9/2004 Stegmeier, Sr. ..... E03F 3/046 52/302.3
6,793,439 B1 * 9/2004 Arm ..... E03F 5/06 24/297
6,860,678 B2 * 3/2005 Gunter ..... E03F 3/046 405/122
6,869,525 B1 * 3/2005 Happel ..... E03F 1/00 210/163
6,905,285 B2 * 6/2005 Little ..... E01C 11/227 405/36
6,908,256 B1 * 6/2005 Humphries ..... E03F 5/06 210/163
6,941,703 B2 * 9/2005 MacLean ..... E04F 19/10 4/612
6,942,419 B2 * 9/2005 Knak ..... E03F 5/06 210/163
6,945,733 B2 * 9/2005 Rathmann ..... E03F 5/06 405/122
6,974,540 B1 * 12/2005 Fleischmann ..... E03F 1/00 210/163
6,986,621 B2 * 1/2006 Allard ..... B01D 29/27 405/36
7,008,137 B2 * 3/2006 Muller ..... E01C 11/225 405/38
7,048,466 B2 * 5/2006 Benesteau ..... E01C 11/227 210/164
7,059,804 B2 * 6/2006 Sieber ..... E03F 3/046 405/118
7,066,685 B2 * 6/2006 Humphries ..... E04C 2/427 210/163
7,125,506 B2 * 10/2006 Humphries ..... E03F 3/046 405/118
7,144,185 B2 * 12/2006 Messerschmidt ..... E03F 5/06 210/164
7,172,368 B2 * 2/2007 Wallace ..... E01C 19/506 249/11
7,201,533 B2 * 4/2007 DeGreef ..... E03F 5/06 404/25
7,246,472 B2 * 7/2007 Nielsen ..... E03F 5/0408 52/302.1
7,252,457 B2 * 8/2007 Humphries ..... H02G 3/0608 405/35
7,264,418 B1 * 9/2007 Houck ..... E03F 3/046 405/47
7,293,937 B2 * 11/2007 Fuchs ..... E05D 7/1077 404/2
7,303,669 B2 * 12/2007 Monneret ..... E02D 29/1427 210/474
7,306,401 B1 * 12/2007 Linkogle ..... E02B 5/02 405/118
7,413,372 B2 * 8/2008 Meyers ..... E03F 3/046 404/2
D582,527 S * 12/2008 Wang ..... D23/267
7,506,844 B2 * 3/2009 Humphries ..... E03F 3/046 405/35
7,507,054 B2 * 3/2009 Fithian ..... E03F 3/046 405/80
7,524,133 B2 * 4/2009 Messerschmidt ..... E03F 5/06 404/4
7,534,071 B2 * 5/2009 Humphries ..... H02G 3/0608 248/48.1
7,588,392 B2 * 9/2009 Wroblewski ..... E03F 5/06 210/163
7,617,644 B2 * 11/2009 Nielsen ..... E03F 5/0407 4/679
7,632,042 B2 * 12/2009 Brafford, Jr. ..... E03F 5/0408 249/11
7,637,694 B1 * 12/2009 Musser ..... E01C 11/227 405/36
7,637,695 B1 * 12/2009 Akkala ..... E03F 3/046 405/118
7,670,080 B2 * 3/2010 Tzaig ..... E02D 29/12 210/170.03
7,670,084 B2 * 3/2010 Aristeo, Jr. ..... B28B 19/0038 52/220.2
7,686,540 B2 * 3/2010 Urriola ..... E01C 11/228 405/53
7,703,502 B2 * 4/2010 Wallace ..... E01C 19/506 428/587
7,736,092 B2 * 6/2010 Hodgekins ..... E04G 15/061 249/11
7,774,870 B2 * 8/2010 Griffin ..... E04H 4/1236 4/507
7,780,855 B2 * 8/2010 Eberly ..... E03F 5/16 210/747.3
7,794,176 B2 * 9/2010 Musser ..... E03F 3/046 52/302.3
7,866,911 B2 * 1/2011 Saadi ..... E03F 3/046 404/2
7,909,531 B2 * 3/2011 Shaw ..... E01C 23/0933 405/36
7,914,229 B2 * 3/2011 Aubusson ..... E03F 5/06 4/510
7,931,421 B2 * 4/2011 Rathmann ..... E03F 5/06 404/2
7,955,027 B2 * 6/2011 Nourian ..... E03F 3/046 405/122
7,967,523 B2 * 6/2011 Hetzler ..... E03F 3/046 405/118
8,075,219 B2 * 12/2011 Greville ..... E03F 5/06 404/2
8,211,298 B2 * 7/2012 Pendleton ..... E03F 5/06 404/5
8,239,974 B2 * 8/2012 Erlebach ..... E03F 5/04 4/290
8,240,946 B2 * 8/2012 Applefield ..... E01C 11/227 405/36
8,272,807 B2 * 9/2012 Shaw ..... E01C 23/0933 405/36
8,292,541 B2 * 10/2012 Akkala ..... E03F 5/06 210/164
D672,015 S * 12/2012 Luke ..... D23/261
8,322,944 B2 * 12/2012 Hodgekins ..... E01C 11/227 405/118
8,419,311 B2 * 4/2013 Shaw ..... E01C 23/0933 404/5
8,469,625 B2 * 6/2013 White ..... E01C 11/08 404/2
8,469,631 B2 * 6/2013 Santi ..... E01C 11/227 405/118
8,474,068 B2 * 7/2013 Kik, Sr. ..... E03F 5/0408 4/679
8,475,079 B2 * 7/2013 Humphries ..... E03F 3/046 249/11
8,486,260 B2 * 7/2013 Tripodi ..... E03F 5/14 210/232
8,505,131 B2 * 8/2013 Doolittle ..... E03F 5/0408 405/118
8,544,219 B1 * 10/2013 Janesky ..... E04B 1/7023 52/302.3
8,677,521 B2 * 3/2014 Stimpson ..... A47K 3/405 4/613
8,678,710 B2 * 3/2014 Dos Santos ..... E03F 3/046 405/118
8,708,603 B2 * 4/2014 Kerkhoff ..... E03F 3/046 405/184.4

(56) References Cited

U.S. PATENT DOCUMENTS 8,734,051 B2 * 5/2014 Kerkhoff ..... E03C 1/12 405/184.4
8,826,613 B1 * 9/2014 Chrien ..... H02G 3/383 52/127.2
8,850,633 B2 * 10/2014 Erlebach ..... E03F 5/04 4/679
8,894,324 B2 * 11/2014 Cucchiara ..... E03F 3/046 405/118
8,911,175 B2 * 12/2014 Koerner ..... E03F 3/046 405/80
8,920,072 B2 * 12/2014 Humphries ..... E03F 3/046 404/4
8,959,858 B1 * 2/2015 Francisco ..... E03F 5/04 52/302.3
8,967,190 B2 * 3/2015 Keizers ..... E03F 5/0407 137/362
8,992,115 B2 * 3/2015 Shaw ..... E03F 3/02 404/5
9,045,874 B1 * 6/2015 Kondas ..... E02D 31/025
9,127,446 B2 * 9/2015 Schlueter ..... E03F 5/04
9,200,464 B1 * 12/2015 Blake ..... E04H 4/00
9,206,593 B2 * 12/2015 Tripodi ..... E03F 5/14
9,334,638 B1 * 5/2016 Kirby ..... A47K 3/40
9,382,701 B2 * 7/2016 Meyers ..... E03F 5/0407
9,469,956 B2 * 10/2016 Koerner ..... E02B 11/00
9,469,982 B2 * 10/2016 Belanger ..... B60S 13/00
9,506,234 B2 * 11/2016 Files, Jr. ..... E03F 3/046
9,567,738 B2 * 2/2017 Schlueter ..... E03F 5/04
9,611,634 B2 * 4/2017 Erlebach ..... E03F 5/0408
9,617,723 B2 * 4/2017 Stonecipher ..... E03F 5/06
D787,028 S * 5/2017 Gomo ..... D23/267
9,643,113 B2 * 5/2017 Farmer ..... E03C 1/264
9,644,363 B2 * 5/2017 Meyers ..... E03F 5/06
9,739,044 B1 * 8/2017 Files, Jr. ..... E03F 3/046
9,739,045 B1 * 8/2017 Jones ..... A47K 3/00
9,765,563 B1 * 9/2017 LaPree ..... E06B 7/08
9,777,489 B2 * 10/2017 Gomo ..... E03F 5/0407
9,784,028 B1 * 10/2017 LaPree ..... E06B 3/70
9,834,894 B1 * 12/2017 Reed ..... E03F 5/0407
9,903,105 B2 * 2/2018 Tomberlin ..... E03F 5/0411
9,932,730 B2 * 4/2018 Files, Jr. ..... E03F 5/06
9,970,188 B2 * 5/2018 Torras-Pique ..... E03F 5/0404
9,995,032 B2 * 6/2018 Meyers ..... E03F 5/0407
10,017,933 B1 * 7/2018 Kirby ..... E03F 5/0408
10,047,511 B2 * 8/2018 Eftekharzadeh ..... E03B 11/10
10,047,512 B2 * 8/2018 Chromey ..... E03F 3/046
10,052,570 B2 * 8/2018 Braun ..... B01D 21/2483
10,060,117 B1 * 8/2018 Marshall ..... E03F 5/0402
10,105,017 B2 * 10/2018 Clear ..... E03F 5/0407
10,132,070 B2 * 11/2018 Madler ..... E01C 11/227
10,165,905 B2 * 1/2019 Sander ..... E03F 5/0408
10,167,621 B2 * 1/2019 Priester ..... E06B 1/70
10,184,239 B2 * 1/2019 Meincke ..... E04C 2/421
10,240,332 B1 * 3/2019 Stetson ..... E02B 11/005
10,240,351 B2 * 3/2019 Gomo ..... E03F 5/06
10,260,223 B2 * 4/2019 Erlebach ..... E03F 5/0408
10,352,032 B2 * 7/2019 Dian ..... E03F 5/06
10,384,155 B1 * 8/2019 DiLalla ..... E03F 5/0404
10,400,436 B2 * 9/2019 Steylaerts ..... E03C 1/284
10,501,926 B2 * 12/2019 Priester ..... E03F 5/0407
10,508,429 B2 * 12/2019 Casey ..... E06B 7/14
10,544,576 B2 * 1/2020 Ismert ..... E03F 5/0401
10,550,563 B1 * 2/2020 Kozlowski ..... E03C 1/22
10,570,628 B2 * 2/2020 Gomo ..... E03F 5/0407
10,590,611 B2 * 3/2020 Kim ..... E01C 11/22
10,604,925 B2 * 3/2020 Blamble ..... E03F 5/0409
10,676,910 B2 * 6/2020 Simon ..... E01C 11/227
10,697,168 B2 * 6/2020 Kozlowski ..... E03F 5/0408
10,724,225 B2 * 7/2020 Brill ..... E03F 5/0408
10,738,494 B1 * 8/2020 Krombein ..... E04H 4/1218
10,765,267 B2 * 9/2020 Secher ..... A47K 3/30
10,774,517 B2 * 9/2020 Chromey ..... E03F 3/046
10,786,765 B2 * 9/2020 DiLalla ..... B01D 29/27
10,829,922 B2 * 11/2020 Brill ..... E03F 5/0408
10,882,772 B1 * 1/2021 Wensel ..... E03F 5/101
D909,544 S * 2/2021 Pohl ..... E03F 5/06 D23/261
10,920,410 B2 * 2/2021 Wadaga ..... E03F 5/0407
RE48,488 E * 3/2021 Belanger ..... E03F 3/046
10,975,583 B2 * 4/2021 Gomo ..... B66B 13/301
D921,167 S * 6/2021 Pohl ..... E03F 5/06 D23/261
11,021,864 B1 * 6/2021 Mjelde ..... E04H 4/06
D924,374 S * 7/2021 Pohl ..... E03F 5/06 D23/261
11,053,674 B2 * 7/2021 Dian ..... E01C 11/227
11,072,916 B2 * 7/2021 Coy ..... E03F 5/0408
11,072,921 B1 * 7/2021 Mjelde ..... E03F 3/046
11,078,658 B2 * 8/2021 Say ..... E03F 5/0411
11,131,069 B2 * 9/2021 Priester ..... E01F 5/00
11,149,429 B2 * 10/2021 Gomo ..... E03F 5/0409
11,241,121 B2 * 2/2022 Brill ..... A47K 3/40
11,312,042 B2 * 4/2022 Brafford, Jr. ..... E04G 13/021
11,312,647 B1 * 4/2022 Wensel ..... E03F 5/0404
11,319,698 B2 * 5/2022 Coy ..... E03F 5/0409
11,384,499 B2 * 7/2022 Luke ..... E03F 3/046
11,408,164 B2 * 8/2022 Gomo ..... E04F 17/00
11,427,997 B2 * 8/2022 Brill ..... E03F 5/0408
11,454,017 B2 * 9/2022 Larson ..... E03F 5/0408
11,459,744 B2 * 10/2022 Swope ..... C02F 1/001
11,473,287 B2 * 10/2022 Blamble ..... E03F 5/0409
11,505,930 B2 * 11/2022 Meyers ..... E03F 5/0408
11,536,016 B2 * 12/2022 Schluter ..... E03F 5/0408
11,549,254 B1 * 1/2023 Mjelde ..... E03F 5/0401
11,607,085 B2 * 3/2023 Cook ..... A47K 3/40
11,612,245 B2 * 3/2023 Meiser ..... A47B 96/021 211/134
11,613,883 B2 * 3/2023 Bernoti ..... E03F 5/0408 210/163
11,617,476 B2 * 4/2023 Welch ..... E03F 5/0408 4/613
11,629,085 B1 * 4/2023 Wensel ..... C02F 9/00 210/170.03
11,655,626 B2 * 5/2023 Meyers ..... A47K 3/40 4/612
11,655,627 B2 * 5/2023 Steinbacher ..... E03F 3/046 210/164
11,661,732 B2 * 5/2023 Gomo ..... E03F 5/0407 4/679
11,674,320 B2 * 6/2023 Gomo ..... E03F 5/06 52/302.1
D993,366 S * 7/2023 DiBacco ..... D23/261
D994,087 S * 8/2023 Strum ..... D23/261
D994,088 S * 8/2023 Strum ..... D23/261
D994,089 S * 8/2023 Strum ..... D23/261
11,746,517 B2 * 9/2023 Kristjansson ..... E03F 3/046 405/119
11,773,580 B2 * 10/2023 Schluter ..... E03F 5/04 4/292
11,795,629 B2 * 10/2023 Wong ..... E03F 5/14
11,795,703 B2 * 10/2023 Ghazalah ..... E04F 19/10
11,808,020 B2 * 11/2023 Robillard ..... E03C 1/26
11,808,024 B2 * 11/2023 Nivelles ..... E03F 5/0409
11,825,994 B2 * 11/2023 Brill ..... A47K 3/40
11,873,635 B2 * 1/2024 Wedi ..... E03F 5/0408
11,905,697 B2 * 2/2024 Valore ..... E03F 5/041
11,913,213 B2 * 2/2024 Larson ..... E03F 5/0408
11,933,034 B2 * 3/2024 Meincke ..... E03F 5/04
D1,024,282 S * 4/2024 DiBacco ..... D23/261
11,976,455 B2 * 5/2024 Gannon ..... E03F 5/0404
12,006,677 B2 * 6/2024 Stokes ..... E03F 5/04
12,018,489 B2 * 6/2024 Majocka ..... E04D 13/0409
12,059,104 B2 * 8/2024 Keizers ..... A47K 3/008
12,116,767 B2 * 10/2024 Blamble ..... E03F 5/0409
12,203,259 B1 * 1/2025 Sacks ..... E03F 5/0408
12,215,493 B1 * 2/2025 Lawrence ..... E03F 1/002
12,247,385 B2 * 3/2025 Wild ..... E03F 5/0408
12,286,783 B2 * 4/2025 Stoltenberg ..... E03F 5/06
12,297,126 B1 * 5/2025 Anguiano ..... C02F 1/283
12,320,112 B2 * 6/2025 Gomo ..... E04F 17/00
12,334,720 B2 * 6/2025 Manabe ..... E03F 5/06
12,366,063 B2 * 7/2025 Say ..... E03F 5/041

(56) References Cited

U.S. PATENT DOCUMENTS 12,404,683 B2 * 9/2025 Gomo ..... E03F 5/0407
2002/0057945 A1 * 5/2002 Dahowski ..... E03F 5/06 405/118
2002/0078496 A1 * 6/2002 Mullings ..... E04H 4/1236 4/507
2002/0113025 A1 * 8/2002 Gauldin ..... E03F 5/0401 210/767
2002/0121466 A1 * 9/2002 McDermott ..... B01D 17/0202 210/164
2002/0154952 A1 * 10/2002 Gunter ..... E01C 19/506 405/121
2002/0159838 A1 * 10/2002 Allard ..... E03F 5/0404 405/43
2003/0019025 A1 * 1/2003 Mullings ..... E04H 4/1236 4/507
2003/0082009 A1 * 5/2003 Humphries ..... E03F 3/046 405/118
2003/0111397 A1 * 6/2003 Stegmeier, Sr. ..... E03F 3/046 52/302.1
2003/0115814 A1 * 6/2003 Nielsen ..... E03F 5/0406 52/302.1
2003/0147693 A1 * 8/2003 Knak ..... E03F 5/06 404/4
2003/0228193 A1 * 12/2003 Little ..... E03F 3/046 405/36
2004/0005194 A1 * 1/2004 Williams ..... E03F 3/046 405/43
2004/0062602 A1 * 4/2004 Dahowski ..... E04H 4/1227 404/2
2004/0081515 A1 * 4/2004 Wallace ..... E01C 19/506 52/11
2004/0136785 A1 * 7/2004 Gunter ..... E03F 3/046 405/36
2005/0025567 A1 * 2/2005 Bricker ..... E03F 3/046 404/2
2005/0025572 A1 * 2/2005 Sanfilippo ..... E03F 3/046 405/36
2005/0055887 A1 * 3/2005 Benesteau ..... E01C 11/227 52/11
2005/0100409 A1 * 5/2005 Houck ..... E03F 3/046 405/125
2005/0100412 A1 * 5/2005 Houck ..... E03F 3/046 405/125
2005/0196238 A1 * 9/2005 DeGreef ..... E03F 5/06 404/25
2005/0230295 A1 * 10/2005 Monneret ..... E03F 5/06 404/5
2005/0232701 A1 * 10/2005 Humphries ..... E04C 2/427 405/43
2005/0238435 A1 * 10/2005 Wallace ..... E01C 19/506 249/11
2005/0238436 A1 * 10/2005 Wallace ..... E01C 19/506 249/11
2005/0281619 A1 * 12/2005 Humphries ..... E03F 3/046 405/122
2006/0048469 A1 * 3/2006 MacLean ..... E03F 5/0402 52/220.3
2006/0157985 A1 * 7/2006 Dahowski ..... E03F 3/046 285/405
2006/0239773 A1 * 10/2006 Meyers ..... E01C 11/227 404/2
2007/0071554 A1 * 3/2007 Stoltengerg ..... B28B 7/18 405/43
2007/0099782 A1 * 5/2007 Saadi ..... E03F 3/046 493/2
2007/0144954 A1 * 6/2007 Neuber ..... E03F 5/06 210/163
2007/0177942 A1 * 8/2007 Meyers ..... E03F 3/046 405/40
2007/0261166 A1 * 11/2007 Burns ..... E03C 1/22 4/665
2007/0274781 A1 * 11/2007 Aubusson ..... E03F 5/06 405/36
2007/0293008 A1 * 12/2007 Hodgekins ..... E04G 21/185 438/270
2008/0005835 A1 * 1/2008 Shipley ..... E03F 5/0407 4/695
2008/0014022 A1 * 1/2008 Wroblewski ..... E03F 5/06 405/119
2008/0019776 A1 * 1/2008 Fithian ..... E03F 3/046 405/118
2008/0022617 A1 * 1/2008 Nielsen ..... E03F 5/0406 52/302.6
2008/0025797 A1 * 1/2008 Brafford, Jr. ..... E03F 5/0407 405/118
2008/0025798 A1 * 1/2008 Humphries ..... E03F 3/046 405/121
2008/0095582 A1 * 4/2008 Aristeo ..... E03F 3/046 405/119
2008/0193217 A1 * 8/2008 Akkala ..... E03F 5/06 405/43
2008/0232900 A1 * 9/2008 Shimono ..... E03F 5/06 404/4
2009/0080970 A1 * 3/2009 Shaw ..... E01C 11/227 404/2
2009/0097921 A1 * 4/2009 Hetzler ..... E03F 3/046 405/119
2009/0103982 A1 * 4/2009 Hodgekins ..... E04G 15/061 405/118
2009/0202302 A1 * 8/2009 Koenig ..... E03F 3/046 405/43
2009/0241440 A1 * 10/2009 Musser ..... E03F 3/046 52/741.1
2009/0241442 A1 * 10/2009 MacLean ..... A01K 1/0151 52/302.1
2009/0266754 A1 * 10/2009 Pendleton ..... B22C 7/04 210/163
2010/0008718 A1 * 1/2010 Cooper ..... E01C 19/4886 404/2
2010/0061805 A1 * 3/2010 Nourian ..... E03F 3/046 405/36
2010/0162481 A1 * 7/2010 Erlebach ..... E03F 5/0408 4/679
2011/0016622 A1 * 1/2011 Dallmer ..... E03F 5/06 4/286
2011/0023978 A1 * 2/2011 Keizers ..... E03F 5/0407 137/362
2011/0047695 A1 * 3/2011 Niedens ..... E03F 5/04 4/679
2011/0061161 A1 * 3/2011 Erlebach ..... E03F 5/0408 4/679
2011/0067175 A1 * 3/2011 Steylaerts ..... E03F 5/0408 4/679
2011/0088161 A1 * 4/2011 Stimpson ..... A47K 3/405 4/613
2011/0091281 A1 * 4/2011 Cucchiara ..... E01C 13/02 405/47
2011/0097146 A1 * 4/2011 Applefield ..... E03F 3/046 404/4
2011/0135384 A1 * 6/2011 Shaw ..... E01C 23/0933 404/72
2011/0162137 A1 * 7/2011 Kik, Sr. ..... E03F 3/046 29/428
2011/0182666 A1 * 7/2011 Brinkschulte ..... E03F 3/046 405/45
2011/0203979 A1 * 8/2011 Schlueter ..... E03F 5/0408 210/164
2011/0204529 A1 * 8/2011 Kerkhoff ..... F16L 3/00 264/34
2011/0303595 A1 * 12/2011 Larsson ..... E03F 5/0408 210/164
2012/0110827 A1 * 5/2012 Doolittle ..... E03F 5/0408 29/527.1
2012/0180294 A1 * 7/2012 Doolittle ..... E04F 15/02188 29/428
2012/0180295 A1 * 7/2012 Doolittle ..... E04F 15/02188 29/428

(56) References Cited

U.S. PATENT DOCUMENTS

2012/0180296 A1* 7/2012 Doolittle ..... E04F 15/02188 29/428
2012/0180415 A1* 7/2012 Doolittle ..... E04F 15/02188 52/302.1
2012/0183352 A1* 7/2012 Humphries ..... E03F 3/046 405/36
2012/0198778 A1* 8/2012 MacLean ..... E04F 17/00 52/302.1
2012/0288330 A1* 11/2012 Altinier ..... E01C 11/227 405/43
2012/0315085 A1* 12/2012 Shaw ..... E01C 23/0933 404/2
2013/0199978 A1* 8/2013 Luke ..... E03F 5/06 210/163
2013/0209166 A1* 8/2013 Shaw ..... E01C 11/227 404/2
2013/0276226 A1* 10/2013 Cook ..... A47K 3/40 4/613
2013/0318704 A1* 12/2013 Plank ..... E03F 5/0408 29/428
2013/0326806 A1* 12/2013 Stonecipher ..... E03F 5/06 29/428
2014/0033423 A1* 2/2014 Cook ..... B29C 45/14065 264/275
2014/0060668 A1* 3/2014 Kerkhoff ..... F16L 3/00 137/356
2014/0110007 A1* 4/2014 Humphries ..... E03F 3/046 29/428
2014/0217644 A1* 8/2014 Brafford, Jr. ..... B29C 39/02 249/177
2014/0332453 A1* 11/2014 Torras-Pique ..... E01C 11/227 210/170.03
2014/0352815 A1* 12/2014 Brodey ..... E03F 5/0409 137/544
2015/0040500 A1* 2/2015 Francisco ..... E04H 4/1227 52/302.3
2015/0233081 A1* 8/2015 Dau ..... E02D 29/14 404/26
2015/0233628 A1* 8/2015 Farmer ..... B01D 35/02 210/166
2015/0240464 A1* 8/2015 Meyers ..... E03F 5/041 210/460
2015/0247312 A1* 9/2015 Brodey ..... E03F 5/0407 404/26
2015/0275498 A1* 10/2015 Belanger ..... E06B 5/01 210/164
2015/0308092 A1* 10/2015 Chromey ..... E03F 3/046 137/363
2015/0330068 A1* 11/2015 Schlueter ..... E03F 5/0408 210/163
2015/0342420 A1* 12/2015 Secher ..... A47K 3/40 29/428
2016/0130794 A1* 5/2016 Erlebach ..... E03F 5/0408 4/613
2016/0174773 A1* 6/2016 Summers ..... E03F 5/0408 4/613
2016/0194861 A1* 7/2016 Nivelles ..... E03F 5/0408 285/42
2016/0281346 A1* 9/2016 Clear ..... E03F 5/0407
2016/0289913 A1* 10/2016 Canney ..... E05B 35/008
2016/0298324 A1* 10/2016 Blamble ..... E03F 3/046
2016/0305109 A1* 10/2016 Meyers ..... E03F 5/041
2016/0319530 A1* 11/2016 Files, Jr. ..... E03F 3/046
2016/0319531 A1* 11/2016 Files, Jr. ..... E03F 3/046
2016/0340889 A1* 11/2016 Tomberlin ..... E03F 5/0404
2016/0362883 A1* 12/2016 Simon ..... E03F 5/0404
2016/0369491 A1* 12/2016 Eftekharzadeh ..... E03F 3/046
2017/0175374 A1* 6/2017 Funari ..... E01C 11/227
2017/0196413 A1* 7/2017 Sander ..... E03F 5/0408
2017/0211267 A1* 7/2017 Stonecipher ..... E03F 5/0408
2017/0218613 A1* 8/2017 Jones ..... A47K 3/00
2017/0226728 A1* 8/2017 Meyers ..... E03F 5/06
2017/0241121 A1* 8/2017 Files, Jr. ..... E01C 11/227
2017/0241124 A1* 8/2017 Erlebach ..... A47K 3/008
2017/0241145 A1* 8/2017 Gomo ..... E03F 5/0407
2017/0314251 A1* 11/2017 Madler ..... E03F 3/046
2017/0314252 A1* 11/2017 Steylaerts ..... E03F 5/0408
2017/0356195 A1* 12/2017 Gomo ..... E03F 5/0407
2018/0038091 A1* 2/2018 Ismert ..... E03F 5/0401
2018/0087260 A1* 3/2018 Priester ..... E06B 1/70
2018/0110379 A1* 4/2018 Wadaga ..... A47K 3/40
2018/0155915 A1* 6/2018 Meyers ..... E03F 5/041
2018/0209131 A1* 7/2018 Dian ..... E01C 11/227
2018/0209132 A1* 7/2018 Dian ..... E03F 5/0401
2018/0245328 A1* 8/2018 Marshall ..... E03F 5/046
2018/0320357 A1* 11/2018 Chromey ..... E03F 3/046
2018/0320358 A1* 11/2018 Chromey ..... E03F 3/046
2018/0340319 A1* 11/2018 Schlüter ..... E03C 1/14
2018/0363284 A1* 12/2018 Casey ..... E03F 5/0407
2019/0024358 A1* 1/2019 Meincke ..... E01C 11/223
2019/0032323 A1* 1/2019 Priester ..... E03F 5/0407
2019/0055727 A1* 2/2019 Jones ..... E03F 5/0408
2019/0106874 A1* 4/2019 Brill ..... E03C 1/22
2019/0169831 A1* 6/2019 Wadaga ..... E03F 5/0408
2019/0169860 A1* 6/2019 Gomo ..... E04F 17/00
2019/0211540 A1* 7/2019 Bernoti ..... E03F 5/0408
2019/0211541 A1* 7/2019 Brill ..... E03F 5/0408
2019/0226194 A1* 7/2019 Stetson ..... E03F 3/046
2019/0316341 A1* 10/2019 Say ..... E03F 3/04
2020/0029747 A1* 1/2020 Wadaga ..... E03F 5/0408
2020/0063413 A1* 2/2020 Coy ..... E03C 1/22
2020/0149261 A1* 5/2020 Kozlowski ..... E03F 5/0408
2020/0173179 A1* 6/2020 Gomo ..... E04F 17/00
2020/0208392 A1* 7/2020 Stetson ..... E03F 3/046
2020/0214510 A1* 7/2020 Brill ..... E03F 5/0408
2020/0217055 A1* 7/2020 Robillard ..... E03F 5/0407
2020/0217059 A1* 7/2020 Blamble ..... E03F 5/0409
2020/0291628 A1* 9/2020 Meyers ..... A47K 3/405
2021/0040721 A1* 2/2021 Larson ..... E03F 5/0408
2021/0076880 A1* 3/2021 Welch ..... A47K 3/40
2021/0102348 A1* 4/2021 Priester ..... E01F 5/00
2021/0115655 A1* 4/2021 Brill ..... E03F 5/0408
2021/0156132 A1* 5/2021 Stetson ..... E03F 5/06
2021/0180308 A1* 6/2021 Gomo ..... E04B 1/34861
2021/0189712 A1* 6/2021 Schluter ..... E03F 5/0407
2021/0230886 A1* 7/2021 Gomo ..... B66B 13/301
2021/0293010 A1* 9/2021 Coy ..... E03F 5/0408
2021/0301518 A1* 9/2021 Meyers ..... A47K 3/40
2021/0317627 A1* 10/2021 Luke ..... E02B 5/02
2021/0355670 A1* 11/2021 Say ..... E03F 5/041
2021/0355671 A1* 11/2021 Schluter ..... E03F 5/0408
2021/0363742 A1* 11/2021 Valore ..... A47K 3/40
2021/0372112 A1* 12/2021 Gunter ..... E01C 19/506
2021/0381216 A1* 12/2021 Stokes ..... E03F 5/04
2022/0034077 A1* 2/2022 Gomo ..... E03F 5/0407
2022/0120073 A1* 4/2022 Meincke ..... E03F 5/04
2022/0127835 A1* 4/2022 Meincke ..... E03F 3/06
2022/0127836 A1* 4/2022 Wild ..... E03F 5/0408
2022/0136252 A1* 5/2022 Bailey ..... E04D 13/0725 248/48.2
2022/0145607 A1* 5/2022 McDonald ..... E03F 5/14
2022/0160182 A1* 5/2022 Brill ..... E03F 5/0408
2022/0192433 A1* 6/2022 Cook ..... A47K 3/40
2022/0195712 A1* 6/2022 Wedi ..... F16J 15/106
2022/0218159 A1* 7/2022 Keizers ..... A47K 3/008
2022/0243484 A1* 8/2022 Ghazalah ..... B66B 13/301
2022/0356693 A1* 11/2022 Kristjansson ..... E03F 5/0402
2022/0364349 A1* 11/2022 Gomo ..... E03F 5/06
2022/0364350 A1* 11/2022 Stetson ..... E03F 5/06
2022/0372744 A1* 11/2022 Steinbacher ..... E02D 29/1427
2022/0389703 A1* 12/2022 Muller ..... E03F 5/06
2023/0035222 A1* 2/2023 Blamble ..... E03F 3/046
2023/0054583 A1* 2/2023 McKee ..... E03F 5/041
2023/0085447 A1* 3/2023 Larson ..... E03F 5/0408 4/679
2023/0210315 A1* 7/2023 Maheu ..... E03F 5/0409 4/613
2023/0216287 A1* 7/2023 Manabe ..... H02G 9/04 174/68.3
2023/0218124 A1* 7/2023 Welch ..... E03F 5/0408 4/613

(56) References Cited

U.S. PATENT DOCUMENTS

2023/0220633 A1* 7/2023 Wong ..... E01C 11/227
2023/0228078 A1* 7/2023 Egli ..... A47K 3/405 4/613
2023/0257985 A1* 8/2023 Gomo ..... E03F 5/06 4/679
2023/0265664 A1* 8/2023 Gomo ..... E04F 17/00 52/302.1
2023/0322582 A1* 10/2023 Ridell ..... G01N 33/18 210/600
2024/0011228 A1* 1/2024 Boere ..... E03F 3/046
2024/0068223 A1* 2/2024 Altunc ..... E03F 5/0408
2024/0125106 A1* 4/2024 Pontarelli ..... E03F 3/046
2024/0159037 A1* 5/2024 MacDonald ..... E03F 5/0408
2024/0191492 A1* 6/2024 Swanson ..... E03F 5/06
2024/0247478 A1* 7/2024 Twaroski ..... E03F 3/046
2024/0271406 A1* 8/2024 Creighton ..... E03F 5/06
2024/0287783 A1* 8/2024 Corona ..... E03F 3/046
2024/0295112 A1* 9/2024 Stokes ..... E03F 5/0408
2024/0318417 A1* 9/2024 Larson ..... E03F 5/0408
2025/0012069 A1* 1/2025 Hallgren ..... E03F 5/06
2025/0034855 A1* 1/2025 Blamble ..... E03F 5/0408
2025/0122713 A1* 4/2025 Blamble ..... E03F 5/0408
2025/0129592 A1* 4/2025 Peters, Jr. ..... E03F 5/0404
2025/0177887 A1* 6/2025 Sedmík ..... E03F 5/06
2025/0243656 A1* 7/2025 Hallgren ..... E03F 5/06
2025/0250786 A1* 8/2025 Dangerfield ..... E03F 5/04

FOREIGN PATENT DOCUMENTS

DE 10242314 A1 * 3/2004 ..... E01C 11/229
DE 202005008841 U1 * 8/2005 ..... E03F 3/046
EP 2206832 A2 * 7/2010 ..... E01C 11/227
GB 916105 A * 1/1963 ..... E03F 3/046

* cited by examiner

TRENCH DRAINS WITH SUSPENDED GRATES

BACKGROUND

Current industrial drainage systems for draining liquid from an industrial complex typically include a drain structure formed in a trench in the floor. The drain structure is typically made of concrete and steel and may include a concrete lip close to the surface of the drain structure. Drain grates may be inserted into an opening on the surface of the drain structure such that the drain grates may be placed on the lip of the drain structure to make the drain grate sit flush with the floor. To prevent north/south movement of the drain grates when, for example, a vehicle rolls over the drain grates, the grates are typically screwed down into the drain structure. This makes these drainage systems tedious to maintain as the drain grates may need to be unscrewed from the drain structure to perform routine maintenance. In addition to possibly stripping the screws during maintenance, one must pull apart the system to clean the trench that houses the drain structure.

Furthermore, after a sustained period of heavy use, the drain grates may be pushed into the drain structure, thereby compromising the structural integrity of the drain structure. Over time, these drainage systems typically have other issues with the structural integrity of the drain structure. For example, portions of the drain structure below the surface may corrode or collapse, wherein the concrete and/or steel in sections of the drain structure may breakdown and compromise the structural integrity of the drain structure. To repair damaged portions of the drain structure, the concrete and/or steel in the damaged sections must be removed and re-poured, a costly endeavor.

SUMMARY

In some implementations, a surface-supported drain grate system includes a plurality of strap-supported grate sections. Each of the strap-supported grate sections includes a drain grate and strapping members. A middle portion of each strapping member is affixed to a top facing section of the drain grate. Outer portions of each strapping member that are not affixed to the drain grate are surface mountable on a surface adjacent to a drain structure in which a strap-supported grate section is inset to provide structural support for the strap-supported grate section.

In some implementations, a strap-supported grate section in a surface-supported drain grate system includes a drain grate, at least one inner strapping member having a middle portion affixed on a top facing inner section of the drain grate; and two anchor strapping members, each of which has a middle portion that is affixed on a top facing edge of the drain grate. Outer portions of each anchor strapping member and outer portions of the inner strapping member are not affixed to the drain grate. The outer portions of the anchor strapping members and the inner strapping member are surface mountable on a surface adjacent to a drain structure in which the strap-supported grate section, fastened or unfastened, is inset to provide structural support for the strap-supported grate section.

Figure 1A:
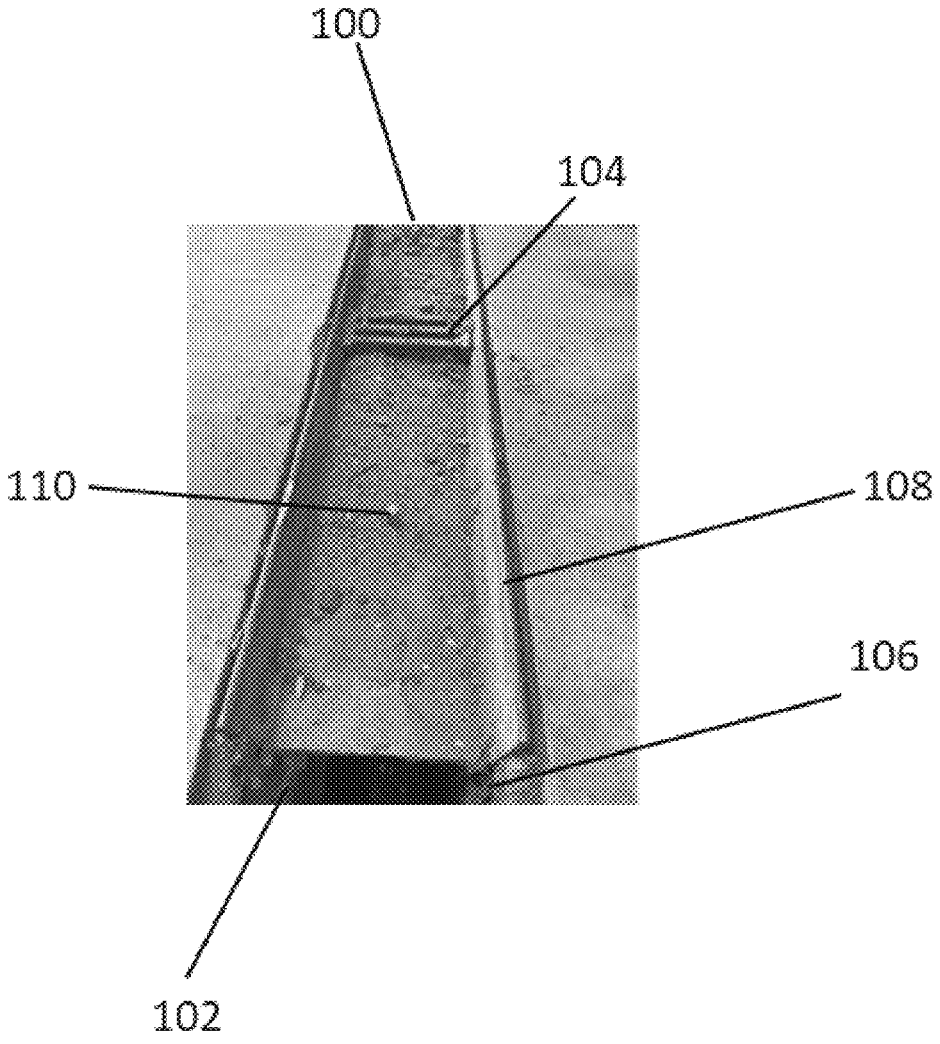
FIGS. 1A-1F show a currently used trench drain system.
Figure 1B:
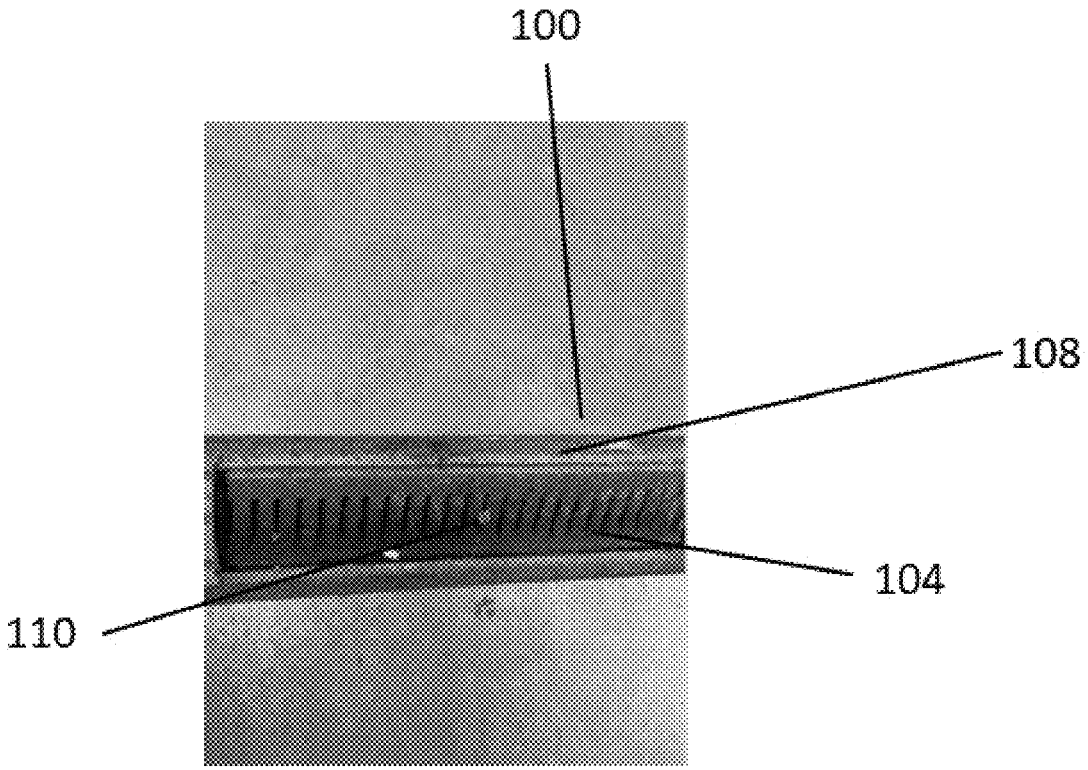
Figure 1C:
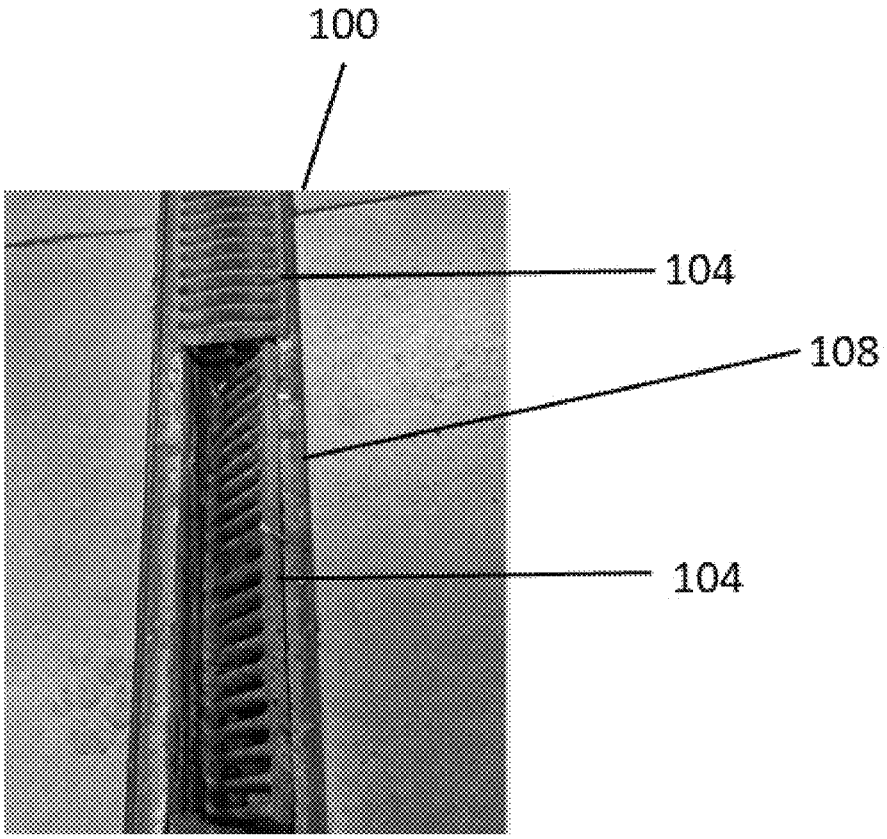
Figure 1D:
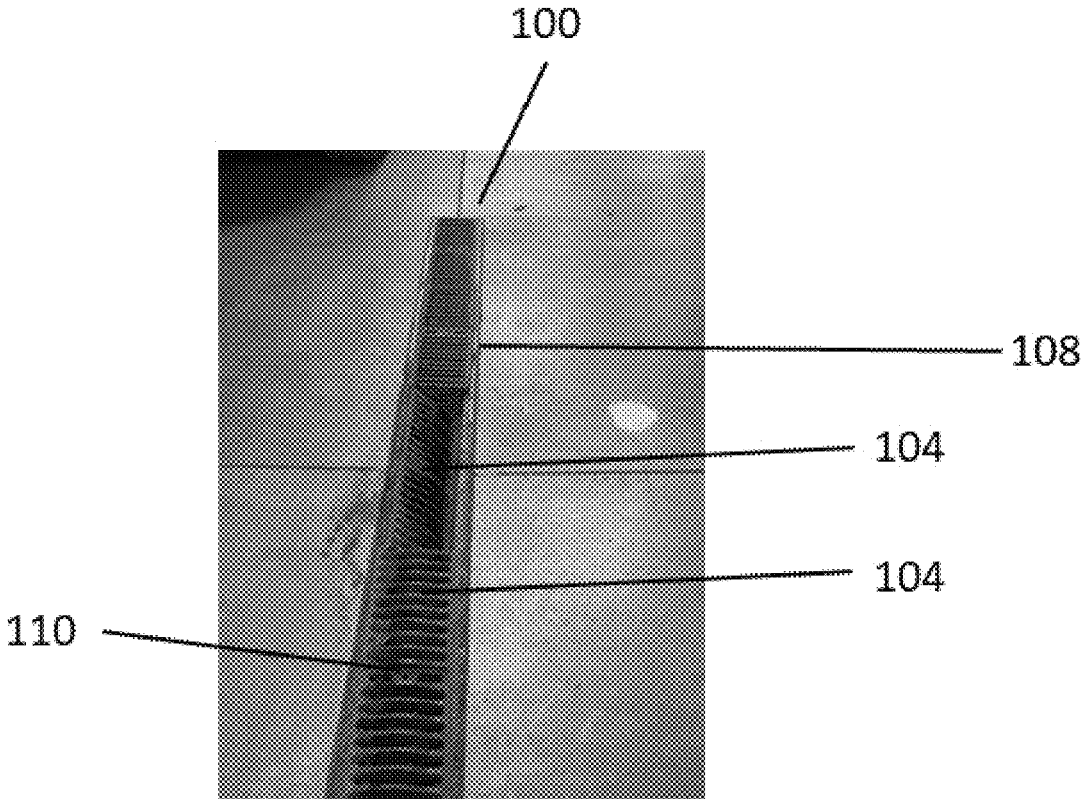
Figure 1E:
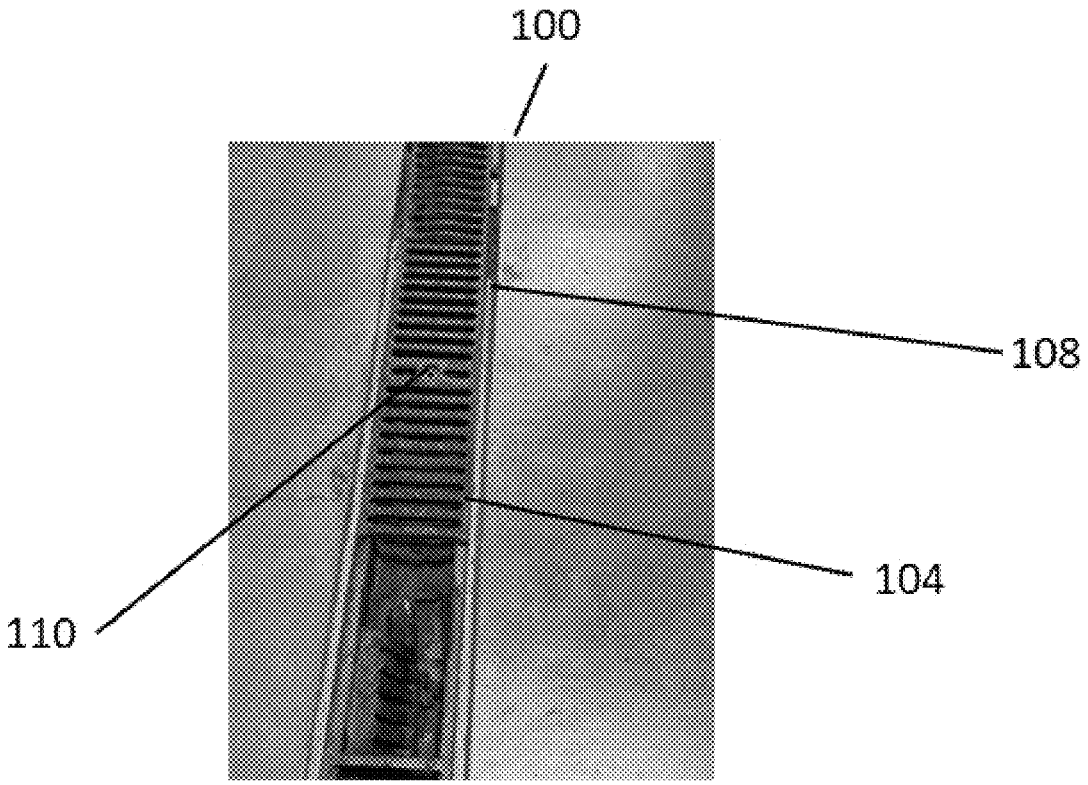

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations of the present disclosure.

The components have been represented where appropriate by conventional symbols in the drawings, showing those specific details that are pertinent to understanding the implementations of the present disclosure so as not to obscure the disclosure with details that will be readily apparent to those of ordinary skill in the art.

DETAILED DESCRIPTION OF THE INVENTION

The following detailed description of example implementations refers to the accompanying drawings. The same reference numbers in different drawings may identify the same or similar elements.

FIGS. 1A-1F show a currently used trench drain system 100 for draining surface liquid from a site. Industrial drain system 100 may be used, for example, in loading zones, areas where water is used to clean equipment, and places where production includes the use of water. Drain system 100 may include a drain structure 102 and drain grates 104. Drain structure 102 may be formed by installing steel or similar material in an excavated ditch or trench, installing a frame or model in the ditch, and pouring concrete in the frame or model. The concrete may be, for example, reinforced concrete or polymer concrete. The concrete may be industrial strength concrete that may be, for example, at least six inches thick. Drain structure 102 may include a lip 106 on which drain grates 104 may sit. Drain grates 104 may be made from iron, steel, or similar materials that can stand up to industrial activities.

To prevent north/south movement of drain grates 104 when, for example, a vehicle rolls over drain grates 104, drain grates 102 may be fastened to a threshold 108. The drain grates and threshold assembly may be seated on lip 106 and inset in an opening on the surface drain structure 102. Drain grates 104 may be fastened to threshold 108 with a fastener 110 including, for example, screws, nail heads, bolts, or the like. To maintain drain system 100, the drain grates and threshold assembly may be decoupled by unfastening drain grates 104 from threshold 108 to, for example, access drain structure 102 for cleaning. Such routine maintenance may possibly lead to stripping of fasteners 110 that are used to fasten drain grates 104 to threshold 108. Furthermore, one may possibly pull apart relatively large sections of the drain grates and threshold assembly to access drain structure 102, making drain system 100 tedious and cumbersome to maintain.

Figure 1F:
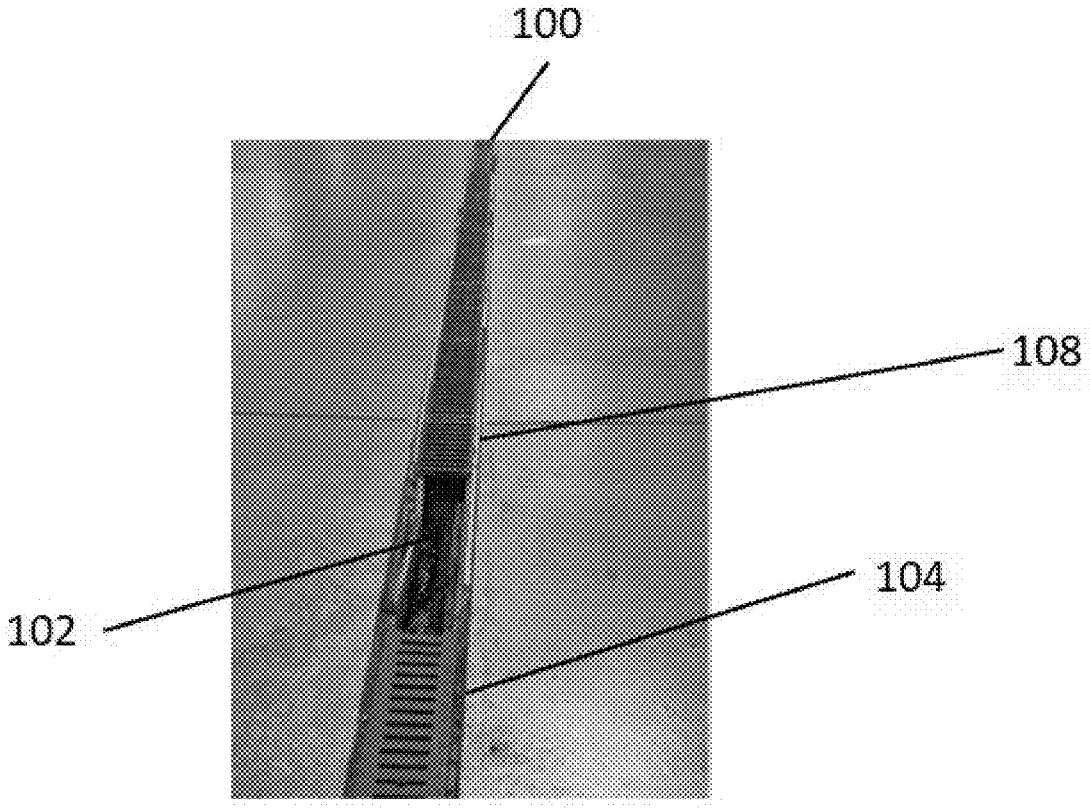

Over time, repeated activities on the concrete in drain structure 102 can cause a concrete ledge (for example, lip 106) or a frame on which drain grates 104 sit to shear off, affecting the structural integrity of drain structure 102, as shown for example in FIG. 1F. In addition, other issues may affect the structural integrity of drain structure 102. For example, drain structure 102 may collapse and/or have issues related to corrosion, causing drain grates 104 to fall in, as shown in FIGS. 1B-1E. Structural issues affecting drain structure 102 are costly to fix. When one or more sections of drain structure 102 are damaged, one may have to cut the metal and/or concrete parts of the damaged section(s) of drain structure 102, recreate a model for the damaged section(s) of drain structure 102, insert the model in the damaged section(s), and re-pour the concrete for the damaged section(s) of drain structure 102.

Figure 2A:
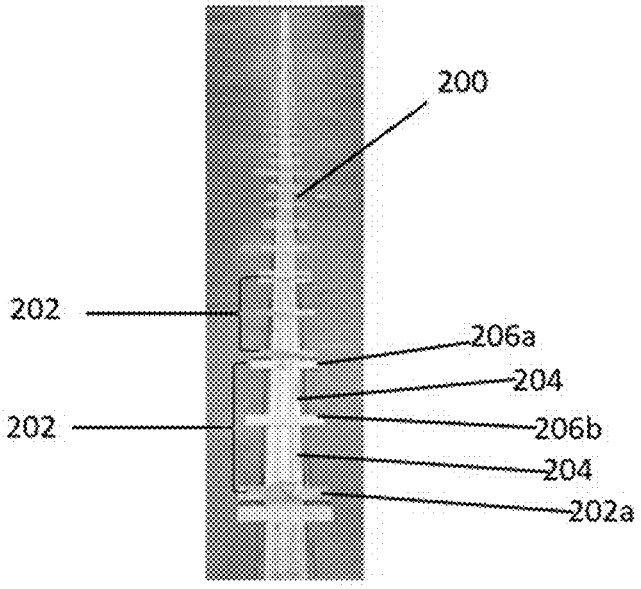
FIGS. 2A-2B show example implementations of a surface-supported drain grate system described herein.
Figure 2B:
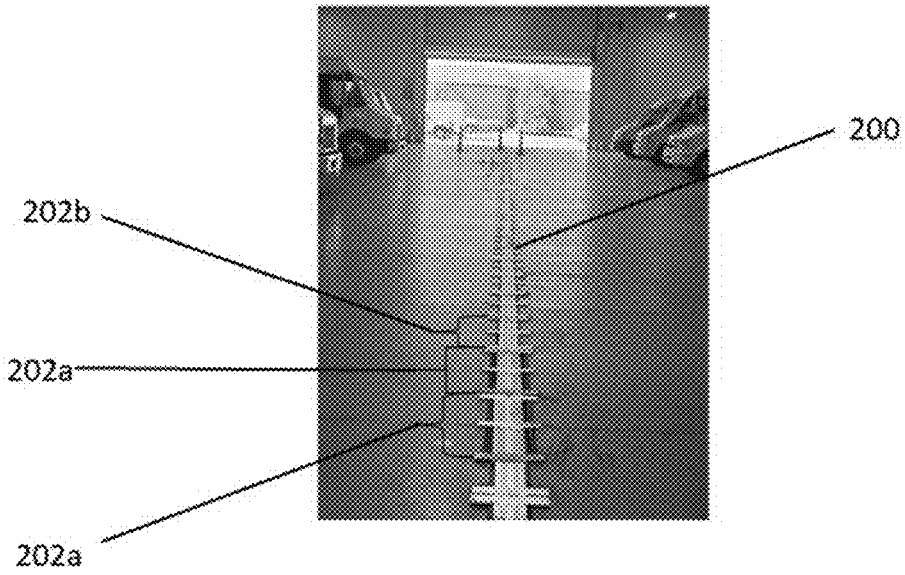

FIGS. 2A-2B show example implementations of a surface-supported drain grate system 200 described herein. Surface-supported drain grate system 200 may be inset in an existing trench drain structure, such as drain structure 102 described in FIGS. 1A-1F. Although surface-supported drain grate system 200 is inset in an existing drain structure, surface-supported drain grate system 200 is not dependent on the structural integrity of the existing drain structure. Surface-supported drain grate system 200 may be supported by the surface adjacent to the existing drain structure. For example, surface-supported drain grate system 200 may be supported by the concrete adjacent to drain structure 102.

Surface-supported drain grate system 200 may include multiple strap-supported grate sections 202 (also shown as, for example, 202*a* and 202*b* in FIG. 2B). Each strap-supported grate section 202 may include a drain grate 204 of a predefined length and strapping members 206 (also shown as, for example, strapping members 206*a* and 206*b*). Drain grate 204 may be, for example, three feet. It should be noted that drain grate 204 may be other lengths outside of the example stated herein. Strap-supported grate sections 202 may be of varying width. For example, strap-supported grate section 202 may be four, six, or eight inches wide. Of course, strap-supported grate section 202 may be other widths outside of the examples stated herein.

FIG. 2A shows a surface-supported drain grate system 200 with multiple strap-supported grate sections 202 having the same dimensions (i.e., width and/or length). FIG. 2B shows a surface-supported drain grate system 200 with multiple strap-supported grate sections 202 having varying dimensions (i.e., different widths and/or lengths). For example, the surface-supported drain grate system 200 in FIG. 2B has two eight-inch-wide strap-supported grate sections 202*a* and one or more six-inches-wide strap-supported grate sections 202*b*. Surface supported drain system 200 may be easily maintained by lifting one or more strap-supported grate sections 202 from drain structure 102.

Drain grate 204 and strapping members 206 may be made from steel or similar material that can withstand industrial activity. Drain grate 204 may include steel of varying thicknesses and strength, wherein a relatively thicker and/or stronger steel may be used for drain grate 204 in a wider strap-supported grate section 202. For example, a relatively thicker steel may be used for drain grate 204 in an eight-inch-wide strap-supported grate section 202*a* than the steel used in a six-inch-wide strap-supported grate section 202*b*.

Strapping members 206 may include two anchor strapping members 206*a*. A middle portion of anchor strapping member 206*a* is located on and affixed to an upper (top facing) end section (edge) of drain grate 204. The placement of anchor strapping members 206*a* on the edges of drain grate 204 prevents north-south (up and down) movements of strap-supported grate section 202 during impact with, for example, a vehicle. Strapping members 206 may also include one or more inner strapping members 206*b*. A middle portion of each inner strapping member 206*b* is located on and affixed to a top facing inner section (between anchor strapping members 206*a*) of drain grate 204. The number of inner strapping members 206*b* in a strap-supported grate section 202 may depend on the width of strapping members 206 relative to the length of drain grate 204, considering that each strapping member 206 covers the section of drain grate 204 to which it is affixed and thus prevents drainage in that section.

Strapping members 206 may be, for example, welded, soldered, or otherwise affixed to the upper surface (top face) of drain grate 204. The height of strapping members 206 may comply with safety standards related to tripping. When strap-supported grate section 202 is inset in drain structure 102, drain grate 204 may be flush with the floor surface. The outer portions of strapping members 206 that are not affixed to drain grate 204 may be surface mounted on the surface adjacent to drain structure 102 to provide structural support for strap-supported grate section 202. For example, when strap-supported grate section 202 is inset in drain structure 102, the outer portions of strapping members 206 that are not affixed to drain grate 204 may be surface mounted on the concrete adjacent to drain structure 102. Strapping members 206 thus use the surface (in this example, concrete) adjacent to the drain structure 102 to structurally support each strap-supported grate section 202.

In some implementations, when inset in drain structure 102, strapping members 206 may support strap-supported grate section 202 without being fastened down to the surface adjacent to drain structure 102. In an example implementation where strapping members 206 provide support without being fastened down to the surface, the surface on which strapping members 206 are mounted may be zero degrees level so that strapping members 206 do not move upon impact with, for example, a vehicle.

In an implementation where the surface adjacent to drain structure 102 cannot be zero degrees level, one or more strapping members 206 may be fastened to the surface adjacent to the drain structure. For example, anchor strapping members 206*a* may be fastened to the concrete adjacent to drain structure 102 with tabs, bolts, or similar fastener, wherein the fasteners may be drilled through anchor strapping members 206*a* and into the concrete. The top of the fasteners may be leveled with the top of anchor strapping members 206*a* or slightly below the top of anchor strapping members 206*a* to prevent the top of the fasteners from being above the top of anchor strapping members 206*a*. As indicated above, FIGS. 2A-2B are provided as examples. Other examples may differ from what is described in FIGS. 2A-2B.

Figure 3A:
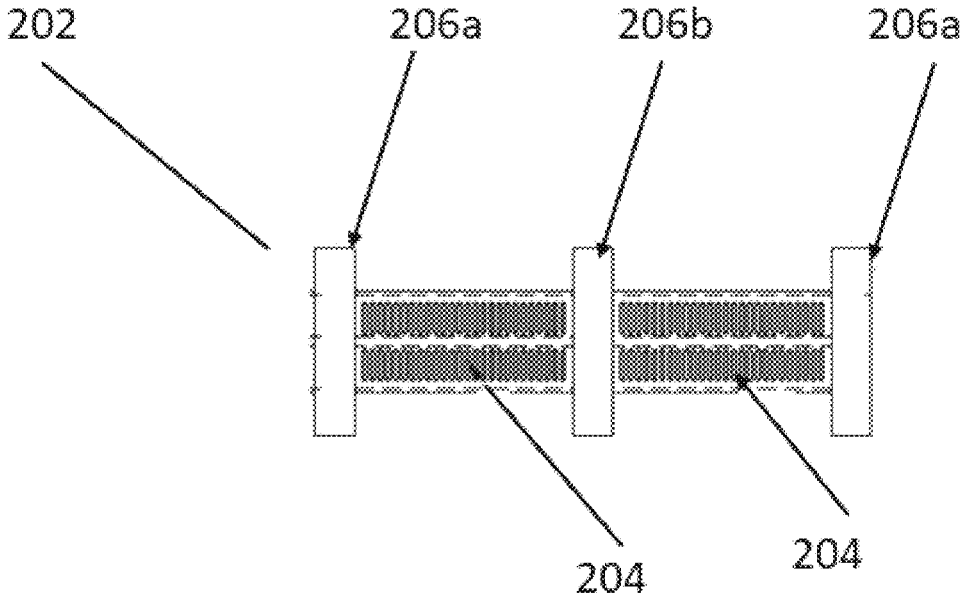
FIGS. 3A-3C show example implementations of a strap-supported grate section of FIGS. 2A-2B.
Figure 3B:
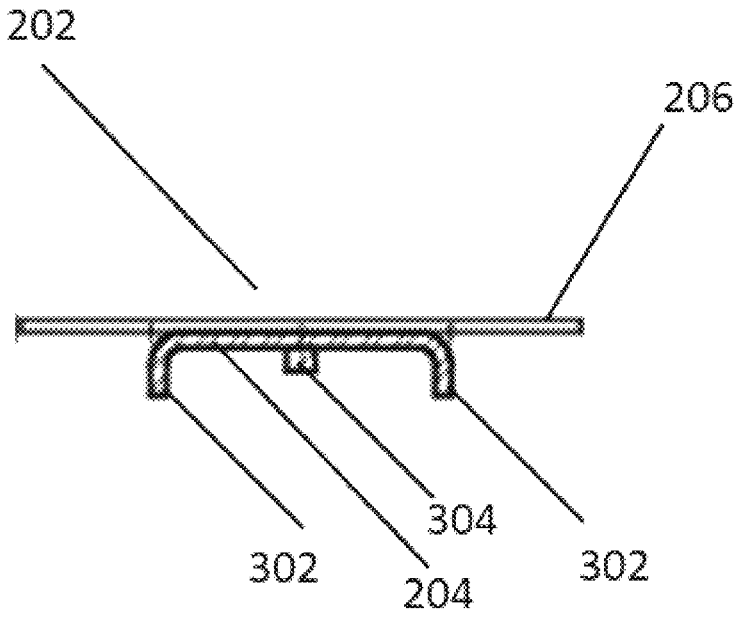
Figure 3C:
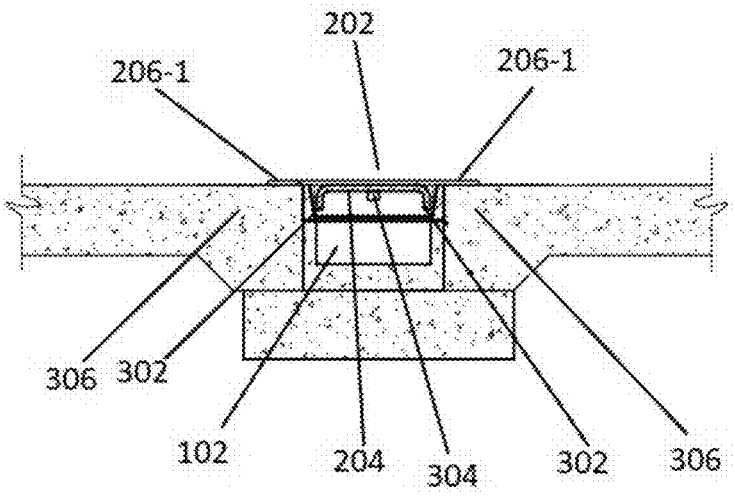

FIGS. 3A-3C further show example implementations of strap-supported grate section 202 of FIGS. 2A and 2B. FIG. 3A shows a top view of an eight-inch-wide strap-supported grate section 202 including anchor strapping members 206*a*. The middle portions of anchor strapping members 206*a* are affixed to top facing edges of drain grate 204. Strap-supported grate section 202 also includes at least one inner strapping member, for example, strapping member 206*b* and the middle portion of inner strapping member 206*b* is affixed over an inner top facing section of drain grate 204. When strap-supported grate section 202 is inset in an opening in drain structure 102, the outer sections of strapping members 206 that are not affixed to drain grate 204 may be mounted on a surface adjacent to drain structure 102 to structurally support strap-supported grate section 202.

FIG. 3B shows a cross-sectional view of the eight-inch-wide strap-supported grate section 202 of FIG. 3A. The eight-inch-wide strap-supported grate section 202 may include drain grate 204 formed of steel having the ability to be bent along the length edges. As shown, for example, in FIG. 3A, anchor strapping members 206*a* may be affixed to the top facing width edges of drain grate 204. FIG. 3B shows that the bottom facing length edges of drain grate 204 may be bent to form bend arms 302 to provide further structural support to strap-supported grate section 202. Bend arms 302 may be long enough to cause end of bend arms 302 to pass a damaged lip edge (for example, lip 106 of drain structure 102) when strap-supported grate section 202 is inset in drain structure 102.

Bend arms 302 may be used to prevent or minimize side-to-side shifting when strap-supported grate section 202 is impacted by, for example, a vehicle. In some implementations, when strap-supported grate section 202 is inset in drain structure 102, the sides of strap-supported grate section 202 may not be flush with the sides of drain structure 102*s*. In these cases, bend arms 302 may reduce side-to-side shifting when strap-supported grate section 202 is impacted by, for example, a vehicle. For example, when strap-supported grate section 202 is inset in a drain structure that has an opening that is slightly larger than the width needed for insetting strap-supported grate section 202 in the drain structure, bend arms 302 may reduce side-to-side shifting of strap-supported grate section 202 in the extra space in the opening when strap-supported grate section 202 is impacted by, for example, a vehicle. In some implementations, drain grate 204 may not include bend arms 302.

Strap-supported grate section 202 may also include an inner support member 304 that is affixed to the center of the bottom facing side of drain grate 204 to provide further structural support to strap-supported grate section 202. Inner support member 304 may be welded to sections of drain grate 204 at predefined points, running along the length of drain grate 204. In some implementations, inner support member 304 may be welded to sections of drain grate 204 at predefined points, without having a continuous inner support member 304 running along the length of drain grate 204.

In some implementations, drain grate 204 may be, for example, a steel channel formed from a mold. The molded drain grate 204 may include flanges (instead of bend arm 302) along the bottom facing length edges of drain grate 204. The flanges may provide further structural support to strap-supported grate section 202 and may be long enough to pass a damaged lip edge (for example, lip 106 of drain structure 102) when strap-supported grate section 202 is inset in drain structure 102. The flanges may also be used to prevent or minimize side-to-side shifting when strap-supported grate section 202 is impacted by, for example, a vehicle. Strap-supported grate section 202 having a molded drain grate 204 may also include an inner support member 304 that is affixed to the center of the bottom facing side of molded drain grate 204 to provide further structural support to strap-supported grate section 202.

FIG. 3C shows a cross-sectional view of the eight-inch-wide strap-supported grate section 202 inset in drain structure 102. Outer portions 206-1 of strapping members 206 that are not affixed to drain grate 204 are supported by surface material 306 adjacent to drain structure 102. By using strapping members 206 and surface material 306 to support strap-supported grate section 202, strap-supported grate section 202 can be inset in drain structure 102 without relying on the structural integrity of drain structure 102. This allows for replacement of drain grate 204 in a damaged drain structure 102 without having to reconstruct drain structure 102 for structural integrity. FIGS. 3A-3C are provided as examples. Other examples may differ from what is described in FIGS. 3A-3C.

Figure 4A:
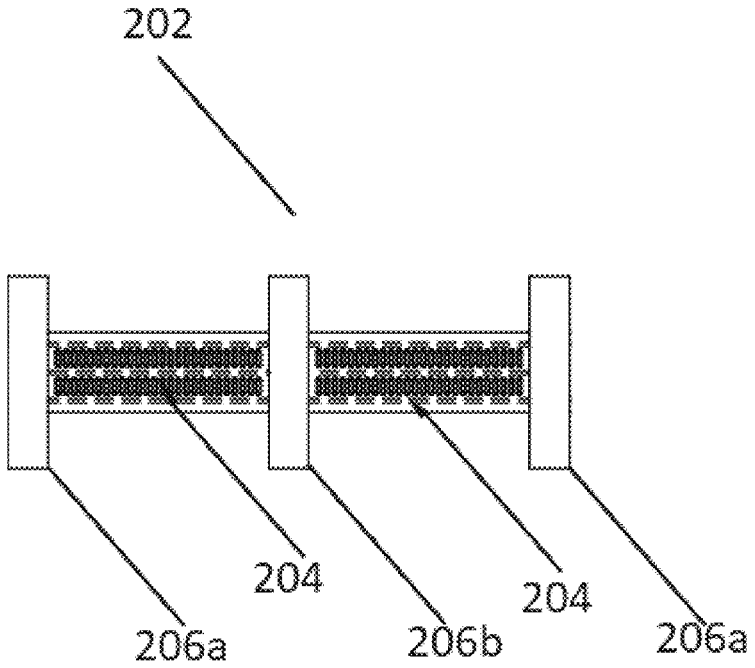
FIGS. 4A-4C show other example implementations of the strap-supported grate section of FIGS. 2A-2B.
Figure 4B:
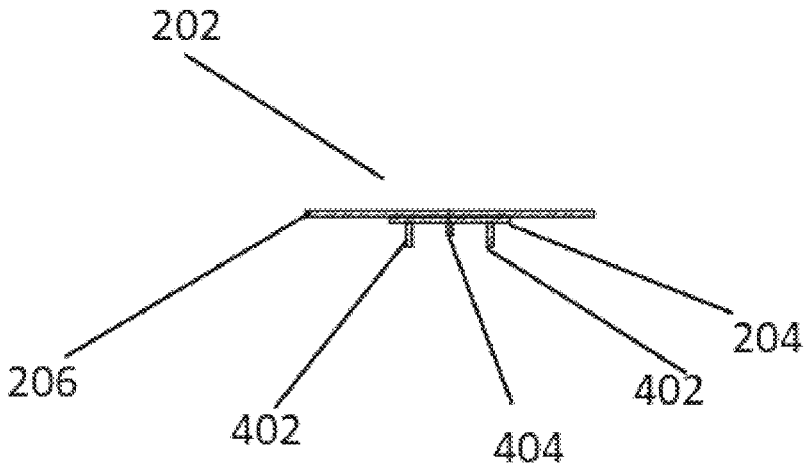
Figure 4C:
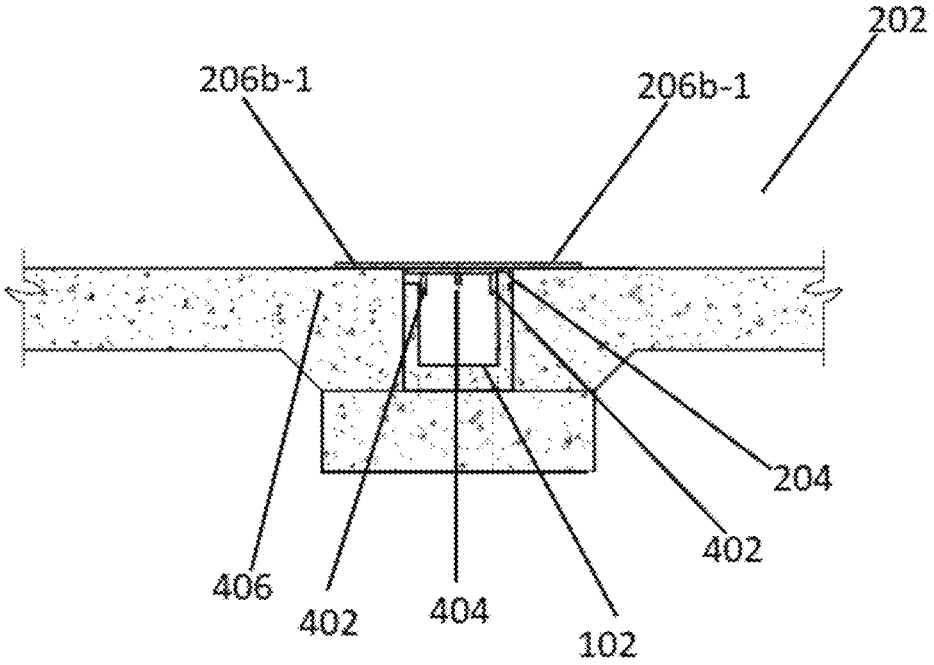

FIGS. 4A-4C show other example implementations of strap-supported grate section 202 of FIGS. 2A and 2B. FIG. 4A shows a top view of four-inch-wide strap-supported grate section 202 including anchor strapping members 206*a* and one inner strapping member 206*b*. The middle portions of anchor strapping members 206*a* are affixed over the top facing edges of drain grate 204 and the middle portion of inner strapping member 206*b* is affixed over an inner top facing section of drain grate 204. The outer portions of strapping members 206 that are not affixed to drain grate 204 may be mounted on top of a surface material, for example, concrete, adjacent to the drain structure into which strap-supported grate section 202 is inset. This provides structural support for strap-supported grate section 202 when strap-supported grate section 202 is inset in drain structure 102.

FIG. 4B shows a cross-sectional view of the six-inch-wide strap-supported grate section 202 of FIG. 4A. Strap-supported grate section 202 may include drain grate 204 formed of steel that may be thinner than the steel used in the eight-inch-wide strap-supported grate section shown in FIGS. 3A-3C. For example, the steel used in drain grate 204 of FIGS. 4A-4C may not be bendable. Strap-supported grate section 202 may include outer support members 402 that are affixed close to bottom facing length edges or at the bottom facing length edges of drain grate 204 to provide further structural support to strap-supported grate section 202. As noted previously, anchor strapping members 206*a* may be affixed to the width edges on the opposite side (i.e., the top facing side) of drain grate 204. Outer support members 402 may be welded to sections of drain grate 204 at predefined points, running along the length of drain grate 204. In some implementations, outer support members 402 may be welded to sections of drain grate 204 at predefined points, without continuously running along the entire length of drain grate 204.

Outer support members 402 may be used to prevent or minimize side-to-side shifting when strap-supported grate section 202 is impacted by, for example, a vehicle. In some implementations, when strap-supported grate section 202 is inset in drain structure 102, the sides of strap-supported grate section 202 may not be flush with the sides of drain structure 102*s*. In these cases, outer support members 402 may reduce side-to-side shifting when strap-supported grate section 202 is impacted by, for example, a vehicle. For example, when strap-supported grate section 202 is inset in a drain structure that has an opening that is slightly larger than the width needed for insetting strap-supported grate section 202 in the drain structure, outer support members 402 may reduce side-to-side shifting of strap-supported grate section 202 in the extra space in the opening when strap-supported grate section 202 is impacted by, for example, a vehicle.

Strap-supported grate section 202 may also include an inner support member 404 that is affixed to the center bottom facing side of drain grate 204 to provide further structural support to strap-supported grate section 202. Inner support member 404 may be welded to sections of drain grate 204 at predefined points, running along the length of strap-supported grate section 202. In some implementations, inner support member 404 may be welded to sections of drain grate 204 at predefined points, without continuously running along the entire length of strap-supported grate section 202.

FIG. 4C shows a cross-sectional view of the six-inch-wide strap-supported grate section 202 inset in drain structure 102. Outer portions 206-1 of strapping members 206 that are not affixed to drain grate 204 are supported by surface material 406 adjacent to drain structure 102. By using strapping members 206 and surface material 406 to support strap-supported grate section 202, strap-supported grate section 202 can be inset in drain structure 102 without relying on the structural integrity of drain structure 102. As indicated above, FIGS. 4A-4C are provided as examples. Other examples may differ from what is described in FIGS. 4A-4C.

Figure 5A:
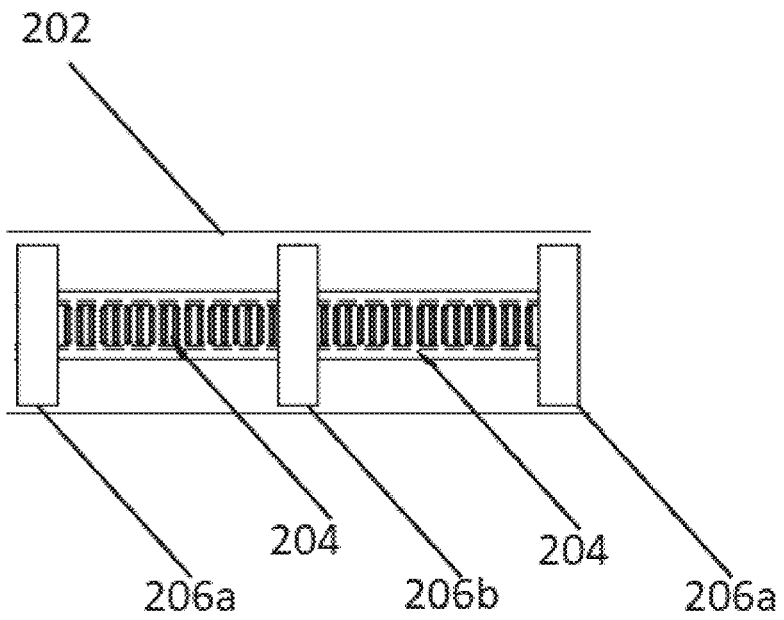
FIGS. 5A-5C show other example implementations of the strap-supported grate section described herein.
Figure 5B:
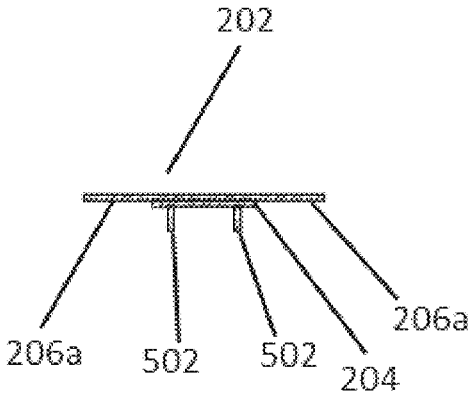
Figure 5C:
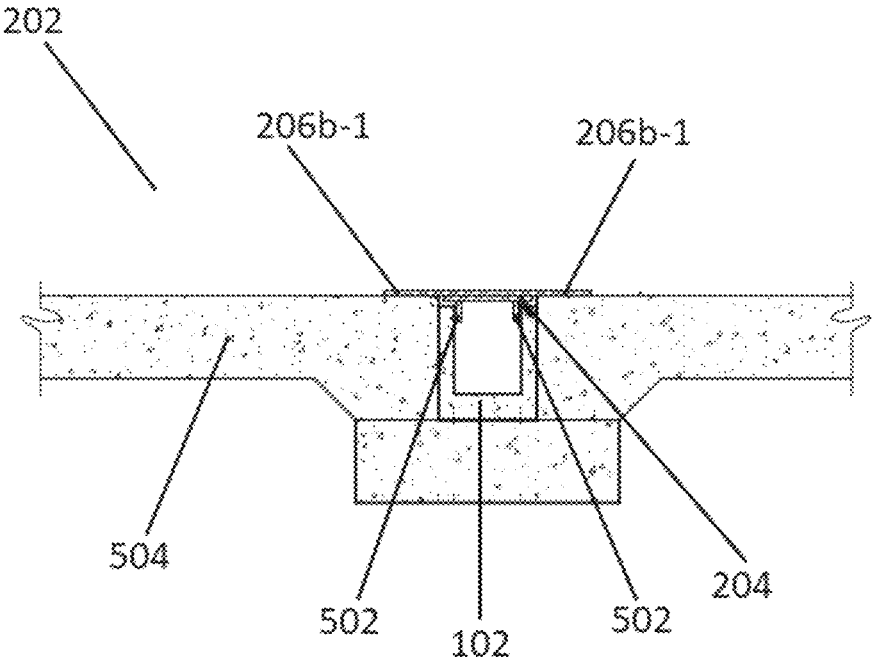

FIGS. 5A-5C show other example implementations of strap-supported grate section 202 described herein. FIG. 5A shows a top view of a four-inch-wide strap-supported grate section 202 including anchor strapping members 206*a* and at least one inner strapping member. Middle portions of anchor strapping members 206*a* are affixed over the top facing edges of drain grate 204 and a middle portion of inner strapping member 206*b* is affixed over an inner top facing section of drain grate 204. To structurally support strap-supported grate section 202, outer portions of strapping members 206 that are not affixed to drain grate 204 may be mounted on top of surface material, for example, concrete, adjacent to drain structure 102 into which strap-supported grate section 202 is inset.

FIG. 5B shows a cross-sectional view of the four-inch-wide strap-supported grate section 202. Strap-supported grate section 202 may include drain grate 204 formed of steel that may not be bendable. Strap-supported grate section 202 may also include outer support members 502 that are affixed at or close to the bottom facing length edges of drain grate 204. Outer support members 502 may provide further structural support to strap-supported grate section 202. Outer support members 502 may be welded to sections of drain grate 204 at predefined points, running along the length of drain grate 204. In some implementations, outer support members 502 may be welded to sections of drain grate 204 at predefined points, without continuously running along the entire length of drain grate 204.

Outer support members 502 may be used to prevent or minimize side-to-side shifting when strap-supported grate section 202 is impacted by, for example, a vehicle. In some implementations, when strap-supported grate section 202 is inset in drain structure 102, the sides of strap-supported grate section 202 may not be flush with the sides of drain structure 102*s*. In these cases, outer support members 502 may reduce side-to-side shifting when strap-supported grate section 202 is impacted by, for example, a vehicle. For example, when strap-supported grate section 202 is inset in a drain structure that has an opening that is slightly larger than the width needed for insetting strap-supported grate section 202 in the drain structure, outer support members 502 may reduce side-to-side shifting of strap-supported grate section 202 in the extra space in the opening when strap-supported grate section 202 is impacted by, for example, a vehicle.

FIG. 5C shows a cross-sectional view of four-inch-wide strap-supported grate section 202 inset in drain structure 102. Outer portions 206-1 of strapping members 206 that are not affixed to drain grate 204 are supported by surface material 504, for example, concrete, adjacent to drain structure 102. By using strapping members 206 and surface material 504 to support strap-supported grate section 202, strap-supported grate section 202 can be inset in drain structure 102 without relying on the structural integrity of drain structure 102. This allows for replacement of drain grate 204 in a damaged drain structure 102 without having to reconstruct drain structure 102 for structural integrity. FIGS. 5A-5C are provided as examples. Other examples may differ from what is described in FIGS. 5A-5C.

The foregoing disclosure provides illustrative and descriptive implementations but is not intended to be exhaustive or to limit the implementations to the precise form disclosed herein. One of ordinary skill in the art will appreciate that various modifications and changes can be made without departing from the scope of the present disclosure as set forth in the claims below. Accordingly, the specification and figures are to be regarded in an illustrative rather than a restrictive sense, and all such modifications are intended to be included within the scope of present teachings.

Even though particular combinations of features are recited in the claims and/or disclosed in the specification, these combinations are not intended to limit the disclosure of various implementations. In fact, many of these features may be combined in ways not specifically recited in the claims and/or disclosed in the specification. Although each dependent claim listed below may directly depend on only one claim, the disclosure of various implementations includes each dependent claim in combination with every other claim in the claim set.

No element, act, or instruction used herein should be construed as critical or essential unless explicitly described as such. Also, as used herein, the articles "a" and "an" are intended to include one or more items and may be used interchangeably with "one or more." Furthermore, as used herein, the term "set" is intended to include one or more items (e.g., related items, unrelated items, a combination of related items, and unrelated items, and/or the like), and may be used interchangeably with "one or more." Where only one item is intended, the term "only one" or similar language is used. Further, the phrase "based on" is intended to mean "based, at least in part, on" unless explicitly stated otherwise.

Moreover, in this document, relational terms such as first and second, top and bottom, and the like, may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "substantially", "essentially", "approximately", "about" or any other version thereof, are defined as being close to as understood by one of ordinary skill in the art, and in one non-limiting implementation the term is defined to be within 10%, in another implementation within 5%, in another implementation within 1% and in another implementation within 0.5%. The term "coupled" as used herein is defined as connected, although not necessarily directly and not necessarily mechanically. A device or structure that is "configured" in a certain way is configured in at least that way but may also be configured in ways that are not listed.

We claim:

1. A suspended trench drain grate system capable of being supported by road surfaces adjacent both sides of the trench, comprising:

a plurality of elongate drain grate sections each having a width permitting inset of the elongate drain grate within the trench such that a top facing surface thereof is substantially flush with the road surfaces; and a plurality of strapping members, wherein a middle portion of each strapping member is affixed to the top facing surface of each elongate drain grate and distal ends of each strapping member are not affixed to the elongate drain grate sections, extending beyond longitudinal edges of each elongate drain grate section, such that the elongate drain grate sections are capable of being supported by the road surfaces, and the plurality of elongate drain grate sections are suspended from the plurality of strapping members without relying on the structural integrity of trench drain structure defining the trench.

2. The suspended trench drain grate system of claim 1, further comprising: bottom facing bend arms to prevent each elongate drain grate section from laterally shifting in the trench.

3. The suspended trench drain grate system of claim 1, further comprising: an inner support member affixed to a center of a bottom facing side of each elongate drain grate section.

4. The suspended trench drain grate system of claim 1, further comprising: outer support members affixed to bottom facing length edges of each of the elongate drain grate sections to minimize lateral shifting of the elongate drain grate sections.

5. The suspended trench drain grate system of claim 1, wherein each top facing surface is zero degrees level, and each elongate drain grate section is not fastened to the road surfaces when the elongate drain grate sections are inset in the trench.

6. The suspended trench drain grate system of claim 1, wherein the plurality of strapping members include anchor strapping members, wherein a middle portion of an anchor strapping member is affixed to a top facing end section of each elongate drain grate section to prevent longitudinal movements of the elongate grate sections along the length of the trench upon contact with a vehicle.

7. The suspended trench drain grate system of claim 6, wherein when each elongate drain grate section is inset in the trench, each elongate drain grate section is fastened to the road surfaces by fastening the anchor strapping members to the road surfaces.

8. The suspended trench drain grate system of claim 1, wherein the plurality of strapping members each include at least one inner strapping member, wherein a middle portion of an inner strapping member is affixed to a top facing inner section of each elongate drain grate section.

9. The suspended trench drain grate system of claim 1, wherein the plurality of elongate drain grate sections are of varying lengths.

10. The suspended trench drain grate system of claim 1, wherein each of the plurality of elongate drain grate sections is inset in the trench and is structurally supported by the road surfaces adjacent to drain structure defining the trench.

11. The suspended trench drain grate system of claim 1, wherein each elongate drain grate is formed from a mold and includes flanges along bottom facing length edges to minimize shifting of the elongate drain grate sections.

12. A strap-suspended elongate grate section for a road surface-supported trench drain grate system, including:

an elongate drain grate having a width permitting inset in the trench;

at least one inner strapping member including a middle portion that is affixed on a top facing inner section of the elongate drain grate; and two anchor strapping members, a middle portion of an anchor strapping member is affixed on a top facing edge of the elongate drain grate, wherein outer portions of the anchor strapping members and the inner strapping member are not affixed to the drain grate, and extend beyond longitudinal edges of the elongate drain grate, such that the elongate drain grate section is capable of being supported by the road surfaces adjacent to both sides of the trench, said outer portions being surface mountable on the road surfaces, wherein, the elongate drain grate section is capable of being inset in the trench, and being structurally supported by the road surfaces, without relying on the structural integrity of trench drain structure defining the trench.

13. The strap-suspended elongate grate section of claim 12, wherein the elongate drain grate includes bottom facing bend arms to minimize lateral shifting of the strap-suspended elongate grate section when within the trench.

14. The strap-suspended elongate grate section of claim 12, further comprises an inner support member affixed to a center of a bottom facing side of the elongate drain grate section.

15. The strap-suspended elongate grate section of claim 12, further comprises outer support members affixed to bottom facing length edges of the elongate drain grate to minimize lateral shifting of the elongate drain grate when inset in the trench.

16. The strap-suspended elongate grate section of claim 12, wherein the road surfaces are zero degrees level, and the elongate drain grate is not fastened to the road surfaces when the elongate drain grate is inset in the trench.

17. The strap-suspended elongate grate section of claim 12, wherein the anchor strapping members prevent longitudinal movements along the length of the trench when the elongate drain grate is contacted by vehicles.

18. The strap-suspended elongate grate section of claim 12, wherein, when the elongate drain grate is inset in the trench, the elongate drain grate is fastened to the road surfaces by fastening the anchor strapping members to the road surfaces.

19. The strap-suspended elongate grate section of claim 12, wherein the elongate drain grate is formed from a mold and includes flanges along bottom facing length edges of the elongate drain grate to minimize shifting of the elongate drain grate when inset in the trench.

* * * * *